US010806979B2

(12) United States Patent
Kimizuka et al.

(10) Patent No.: US 10,806,979 B2
(45) Date of Patent: Oct. 20, 2020

(54) FITTING METHOD OF GOLF CLUB

(71) Applicant: DUNLOP SPORTS CO. LTD., Kobe-shi, Hyogo (JP)

(72) Inventors: Wataru Kimizuka, Kobe (JP); Masahide Onuki, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 1462 days.

(21) Appl. No.: 13/871,055

(22) Filed: Apr. 26, 2013

(65) Prior Publication Data

US 2013/0288829 A1 Oct. 31, 2013

(30) Foreign Application Priority Data

Apr. 27, 2012 (JP) ..... 2012-103726
Apr. 27, 2012 (JP) ..... 2012-104032

(51) Int. Cl.

*A63B 57/00* (2015.01)
*A63B 60/00* (2015.01)
*A63B 69/36* (2006.01)
*A63B 24/00* (2006.01)

(52) U.S. Cl.

CPC ..... *A63B 60/00* (2015.10); *A63B 24/0006* (2013.01); *A63B 69/3623* (2013.01); *A63B 2024/0012* (2013.01); *A63B 2069/3605* (2013.01); *A63B 2220/805* (2013.01); *A63B 2220/807* (2013.01)

(58) Field of Classification Search

USPC ..... 473/199.409, 221–222, 151, 199
See application file for complete search history.

(56) References Cited

U.S. PATENT DOCUMENTS 5,471,383 A * 11/1995 Gobush et al. ..... 700/91
5,501,463 A * 3/1996 Gobush et al. ..... 473/199
5,575,719 A * 11/1996 Gobush et al. ..... 473/223
5,935,014 A * 8/1999 Lindsay ..... 473/222
6,083,123 A * 7/2000 Wood ..... 473/409
6,192,323 B1 * 2/2001 Boehm ..... 702/182

(Continued)

FOREIGN PATENT DOCUMENTS

JP 59-122175 U 8/1984
JP 7-227453 A 8/1995

(Continued)

*Primary Examiner* — Eugene L Kim
*Assistant Examiner* — Matthew B Stanczak
(74) *Attorney, Agent, or Firm* — Birch, Stewart, Kolasch & Birch, LLP

(57) ABSTRACT

This fitting method includes, for example, the following steps A1 to E1:

(A1) a step of measuring a plurality of impact conditions using a reference club;

(B1) a step of obtaining hit ball arrival point data;

(C1) a step of selecting two or more of the plurality of impact conditions as explanation variables and performing multiple linear regression analysis with the hit ball arrival point data as an objective variable;

(D1) a step of selecting a specific explanation variable from the two or more explanation variables based on a result of the multiple linear regression analysis; and (E1) a step of determining a recommended club including a specification capable of suppressing variation in the specific explanation variable.

6 Claims, 20 Drawing Sheets

(56) References Cited

U.S. PATENT DOCUMENTS

| | | | | |
|---|---|---|---|---|
| 6,592,465 | B2 * | 7/2003 | Lutz et al. | 473/198 |
| 6,611,792 | B2 * | 8/2003 | Boehm | 702/182 |
| 6,658,371 | B2 * | 12/2003 | Boehm et al. | 702/182 |
| 7,232,375 | B1 * | 6/2007 | Robert et al. | 473/220 |
| 7,837,572 | B2 * | 11/2010 | Bissonnette et al. | 473/151 |
| 7,959,517 | B2 * | 6/2011 | Lastowka | 473/198 |
| 8,371,962 | B2 * | 2/2013 | Solheim et al. | 473/407 |
| 8,475,289 | B2 * | 7/2013 | Bissonnette et al. | 473/151 |
| 8,512,162 | B2 * | 8/2013 | Kim et al. | 473/221 |
| 8,556,267 | B2 * | 10/2013 | Gobush | 273/317.2 |
| 8,747,246 | B2 * | 6/2014 | Swartz et al. | 473/278 |
| 8,872,914 | B2 * | 10/2014 | Gobush | 348/135 |
| 8,982,216 | B2 * | 3/2015 | Ishii et al. | 348/157 |
| 2001/0029207 | A1 * | 10/2001 | Cameron et al. | 473/151 |
| 2002/0103035 | A1 * | 8/2002 | Lindsay | 473/151 |
| 2002/0155896 | A1 * | 10/2002 | Gobush et al. | 473/197 |
| 2004/0127303 | A1 | 7/2004 | Teraoka | |
| 2005/0159231 | A1 * | 7/2005 | Gobush | 473/131 |
| 2005/0261071 | A1 * | 11/2005 | Cameron | 473/219 |
| 2006/0030431 | A1 * | 2/2006 | Rankin et al. | 473/407 |
| 2006/0068927 | A1 * | 3/2006 | Rankin et al. | 473/151 |
| 2007/0018396 | A1 | 1/2007 | Kajita | |
| 2007/0167247 | A1 * | 7/2007 | Lindsay | 473/131 |
| 2007/0298895 | A1 * | 12/2007 | Nusbaum et al. | 473/131 |
| 2007/0298896 | A1 * | 12/2007 | Nusbaum et al. | 473/131 |
| 2008/0200274 | A1 * | 8/2008 | Haag et al. | 473/222 |
| 2009/0131189 | A1 * | 5/2009 | Swartz et al. | 473/221 |
| 2009/0131193 | A1 * | 5/2009 | Swartz et al. | 473/289 |
| 2009/0270204 | A1 * | 10/2009 | Saegusa et al. | 473/409 |
| 2010/0151956 | A1 * | 6/2010 | Swartz et al. | 473/199 |
| 2011/0009215 | A1 * | 1/2011 | Ichikawa et al. | 473/409 |
| 2011/0159979 | A1 | 6/2011 | Iwade et al. | |
| 2012/0108363 | A1 * | 5/2012 | Hasegawa et al. | 473/409 |
| 2012/0108364 | A1 * | 5/2012 | Hasegawa et al. | 473/409 |
| 2012/0302379 | A1 * | 11/2012 | Margoles et al. | 473/407 |
| 2013/0143685 | A1 * | 6/2013 | Margoles et al. | 473/231 |
| 2013/0260909 | A1 * | 10/2013 | Margoles et al. | 473/223 |

FOREIGN PATENT DOCUMENTS

| | | | |
|---|---|---|---|
| JP | 2002-301172 | A | 10/2002 |
| JP | 2003-102892 | A | 4/2003 |
| JP | 2004-24488 | A | 1/2004 |
| JP | 2010-155074 | A | 7/2010 |

* cited by examiner

FITTING METHOD OF GOLF CLUB

The present application claims priority on Patent Application No. 2012-103726 filed in JAPAN on Apr. 27, 2012 and Patent Application No. 2012-104032 filed in JAPAN on Apr. 27, 2012, the entire contents of which are hereby incorporated by reference.

BACKGROUND OF THE INVENTION

Field of the Invention

The present invention relates to a fitting method of a golf club.

Description of the Related Art

Selection of a golf club adapted to a golf player is referred to as fitting. The fitting greatly influences a hit ball result.

One of head physical properties is a loft angle. A typical loft angle is a real loft angle. The real loft angle is an angle of inclination of a face surface to a shaft axis line. The golf player selects a loft angle considered to be adapted to the golf player. However, the selection is not necessarily easy. A significant difference may be generated in hit ball characteristics such as a flight distance by a slight difference between the loft angles. It is difficult to determine the loft angle recommended to each golf player.

Data is generally measured from a golf player's swing. In Japanese Patent Application Laid-Open Nos. 7-227453 and 2004-24488, the three-dimensional position and posture of a head in an impact are measured.

Performing fitting based on measured data is proposed. In Japanese Patent Application Laid-Open No. 2010-155074, the combination of a head and shaft is selected based on the behavior of the head. Japanese Patent Application Laid-Open No. 2010-155074 describes that, for example, a golf club is preferable, which is set so that a dynamic loft is increased and a face surface is not closed when being viewed from a golf player when a vertical entering angle is negative and a lateral entering angle is positive.

Japanese Patent Application Laid-Open No. 2011-130932 (US2011/0159979) discloses a shaft selection assist apparatus. Recommended shaft information is used in the invention. The recommended shaft information is information specifying a recommended shaft based on a relationship of a shaft rigidity distribution with respect to a vertical launch angle and a backspin rate.

Japanese Patent Application Laid-Open No. 2007-29257 (US2007/0018396) discloses a setting method of an iron golf club for adding two or more golf clubs for a range shorter than that of a pitching wedge.

SUMMARY OF THE INVENTION

In Japanese Patent Application Laid-Open No. 2007-29257, a golf club is added based on a flight distance. For example, an average flight distance can be employed in analysis based on the flight distance. The reliability of data can be improved by employing the average value.

Hit ball results such as the flight distance are varied.

In many golf players, the variation is great. The variation cannot be evaluated by an average value and a maximum value which are conventionally employed. The decrease in the variation means improvement in a possibility of landing a ball in a position intended by the golf player. In many cases, the decrease in the variation leads to a good score.

It is a first object of the present invention to provide a method capable of improving fitting accuracy.

A loft angle greatly influences the hit ball result. An optimal hit ball result can be effectively obtained by making a dynamic loft proper. The present inventors found a method for determining a recommended loft angle with accuracy based on a novel technical thought.

It is a second object of the present invention is to determine a recommended loft angle adapted to each golf player with accuracy to improve club fitting accuracy.

A fitting method according to a first aspect of the present invention includes the following step A1, step B1, step C1, step D1, and step E1:

(A1) a step of measuring a plurality of impact conditions using a reference club;

(B1) a step of obtaining hit ball arrival point data;

(C1) a step of selecting two or more of the plurality of impact conditions as explanation variables and performing multiple linear regression analysis with the hit ball arrival point data as an objective variable;

(D1) a step of selecting a specific explanation variable from the two or more explanation variables based on a result of the multiple linear regression analysis; and (E1) a step of determining a recommended club including a specification capable of suppressing variation in the specific explanation variable.

Preferably, the specific explanation variable is selected based on a degree of contribution to the objective variable.

Preferably, the degree of contribution is a standard partial regression coefficient.

Preferably, the explanation variables in the step C1 are selected by a variable selection method.

Preferably, the impact conditions are two or more selected from a head speed, a face angle, a shaft angle, a lie angle, a dynamic loft, an entering angle, a blow angle, a lateral hit point, and a vertical hit point.

Preferably, the hit ball arrival point data is at least one selected from a flight distance and lateral deviation.

A fitting method according to a second aspect of the present invention includes the following step A2, step B2, step C2, and step D2:

(A2) a step of measuring a subject's head speed, dynamic loft, and blow angle using a reference club;

(B2) a step of determining a suitable dynamic loft predicted that a hit ball result is good based on the measured head speed and the measured blow angle;

(C2) a step of determining a dynamic loft difference from the suitable dynamic loft and the measured dynamic loft; and (D2) a step of determining a recommended loft angle based on a loft angle of the reference club and the dynamic loft difference.

Preferably, the recommended loft angle is selected from a plurality of previously prepared recommended loft angle candidates in the step D2.

Preferably, the hit ball result is a flight distance.

Preferably, a hit ball result database obtained by actual measurement and/or a simulation is used in the prediction in the step B2.

Preferably, the hit ball result database is correlation data between the dynamic loft and the blow angle which are created for each head speed.

Preferably, the hit ball results in the dynamic lofts in the measured blow angle are compared using the hit ball result database in the prediction in the step B2.

The method of the first aspect of the present invention can determine a recommended club capable of suppressing variation in a hit ball arrival point. Highly accurate club fitting can be attained by suppressing the variation.

The method of the second aspect of the present invention can select a proper loft angle with accuracy. Therefore, the fitting of the golf club improving the hit ball result can be appropriately performed.

DESCRIPTION OF THE PREFERRED EMBODIMENTS

Hereinafter, the present invention will be described in detail based on preferred embodiments with appropriate reference to the drawings.

A loft angle in the present application is a real loft angle.

Embodiment According to First Aspect of the Present Invention

Figure 1:
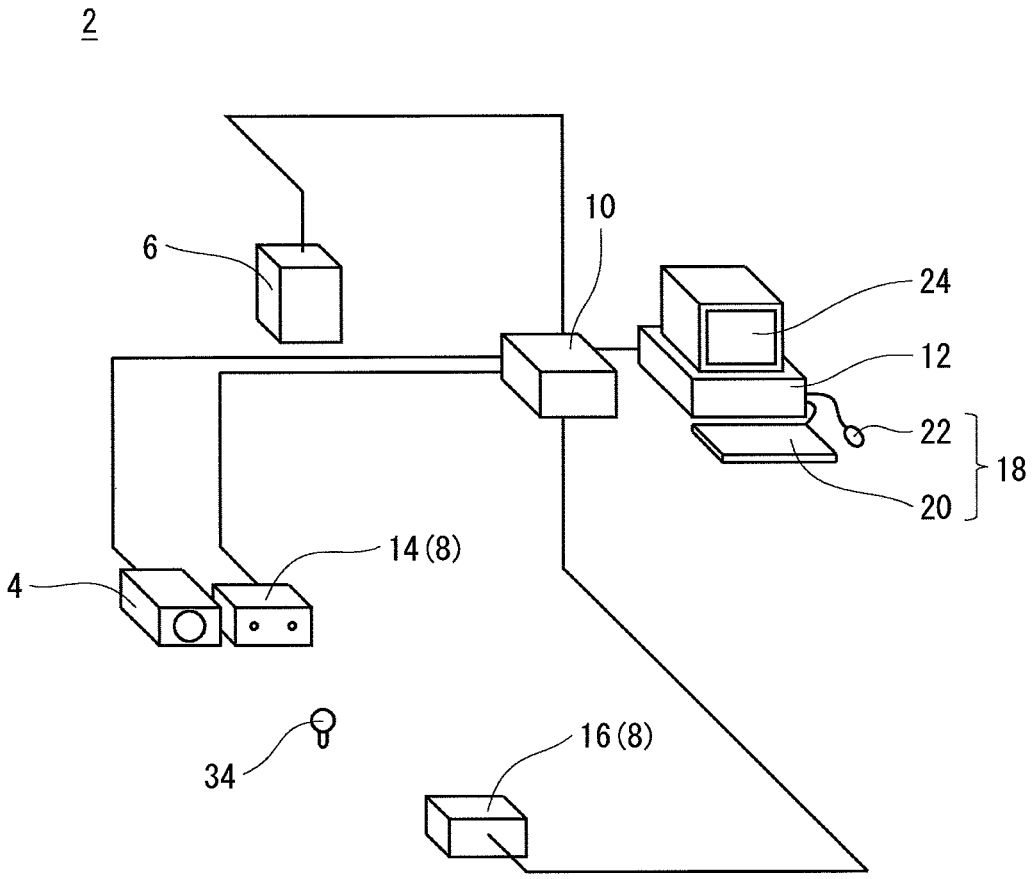
FIG. 1 is a schematic view showing a constitution of a fitting apparatus according to the present invention.

FIG. 1 shows an example of an apparatus capable of being used for a fitting method of the present invention. The fitting apparatus 2 includes a front camera 4 and an upper camera 6 as an image photographing part, a sensor 8, a control apparatus 10, and an information processor 12 as a calculating part. The sensor 8 includes a light emitting unit 14 and a light receiving unit 16.

The front camera 4 is located at the front of a swinging golf player (subject). The front camera 4 is disposed in a position and a direction in which a head and a shaft near an impact can be photographed. The upper camera 6 is located above a position on which a ball 34 is placed. The upper camera 6 is disposed in the position and the direction in which the head and the shaft near the impact can be photographed. Examples of the front camera 4 and the upper camera 6 include a CCD camera. The front camera 4 and the upper camera 6 are exemplified. A front camera capable of photographing a face surface near the impact may be provided. The front camera can improve the measurement accuracy of a hit point.

The light emitting unit 14 of the sensor 8 is located at the front of the swinging golf player. The light receiving unit 16 is located at the feet of the swinging golf player. The light emitting unit 14 and the light receiving unit 16 are disposed in such positions that a swung golf club passes between the light emitting unit 14 and the light receiving unit 16. The sensor 8 can detect the head or shaft of the passing golf club. The sensor 8 may be disposed in a position in which the head or the shaft can be detected, and may be disposed on the front side or the back side. The sensor 8 is not limited to one including the light emitting unit 14 and the light receiving unit 16. The sensor 8 may be a reflective type.

The control apparatus 10 is connected to the front camera 4, the upper camera 6, the sensor 8, and the information processor 12. The control apparatus 10 can transmit a photographing start signal and a photographing stop signal to the front camera 4 and the upper camera 6. The control apparatus 10 can receive a signal of a head image from the front camera 4 and the upper camera 6. The control apparatus 10 can receive a detection signal of the head or shaft from the sensor 8. The control apparatus 10 can output the signal of the head image and the detection signal of the head or shaft to the information processor 12.

Figure 2:
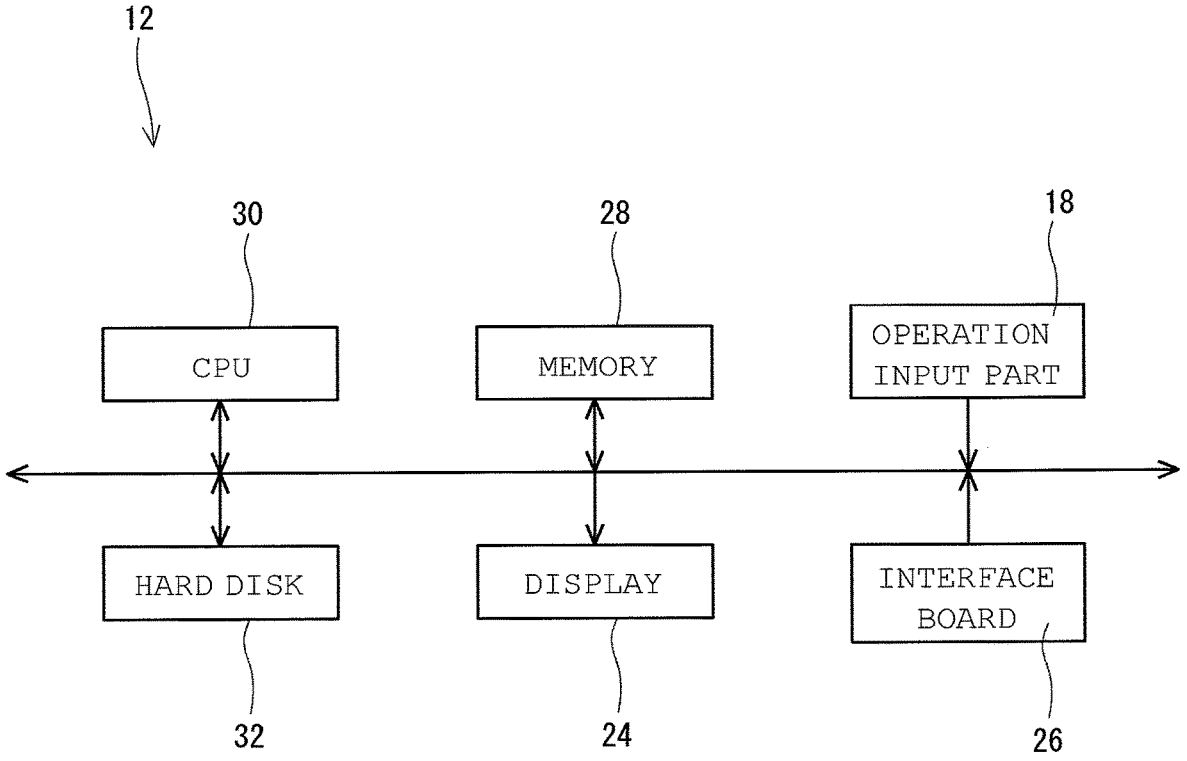
FIG. 2 is an illustration showing a system constitution of an information processor constituting the fitting apparatus of FIG. 1.

As shown in FIGS. 1 and 2, the information processor 12 includes a keyboard 20 and a mouse 22 as an information input part 18, a display 24 as an output part, an interface board 26 as a data input part, a memory 28, a CPU 30, and a hard disk 32. A general-purpose computer may be used as it is, as the information processor 12.

The display 24 is controlled by the CPU 30. The display 24 displays various information. The output part can display fitting information such as a recommended loft angle, a recommended head, a recommended club, and measurement data. The output part is not limited to the display 24, and for example, a printer may be used.

The signal of the head image and/or shaft image and the detection signal of the head or shaft, or the like are input into the interface board 26. Measurement data is obtained from the signal of the image and the detection signal. The measurement data is output to the CPU 30.

The memory 28 is a rewritable memory. The hard disk 32 stores a program and data or the like. A program for executing each step to be described later is stored. A database for selecting the recommended club to be described later is stored. The memory 28 constitutes a storing area and a working area for a program and measurement data read from the hard disk 32, or the like.

The CPU 30 can read the program stored in the hard disk 32. The CPU 30 can develop the program in the working area of the memory 28. The CPU 30 can execute various processings according to the program.

Figure 3:
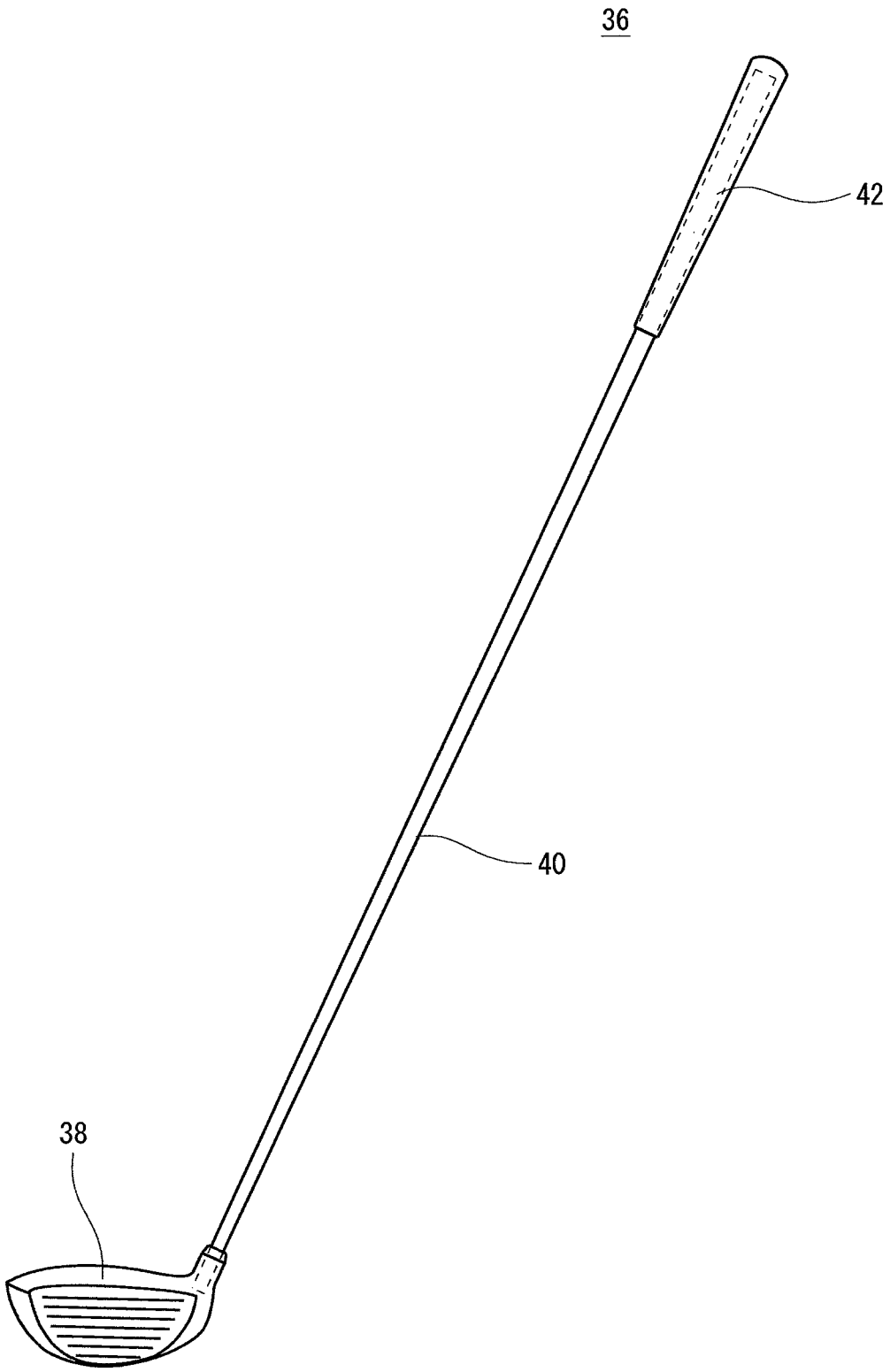
FIG. 3 is a front view showing an example of a reference club.

A golf club 36 shown in FIG. 3 is an example of the golf club used in the fitting apparatus 2. The golf club used for measurement is referred to as a reference club. The golf club 36 is an example of the reference club. The golf club 36 includes a head 38, a shaft 40, and a grip 42.

Figure 4:
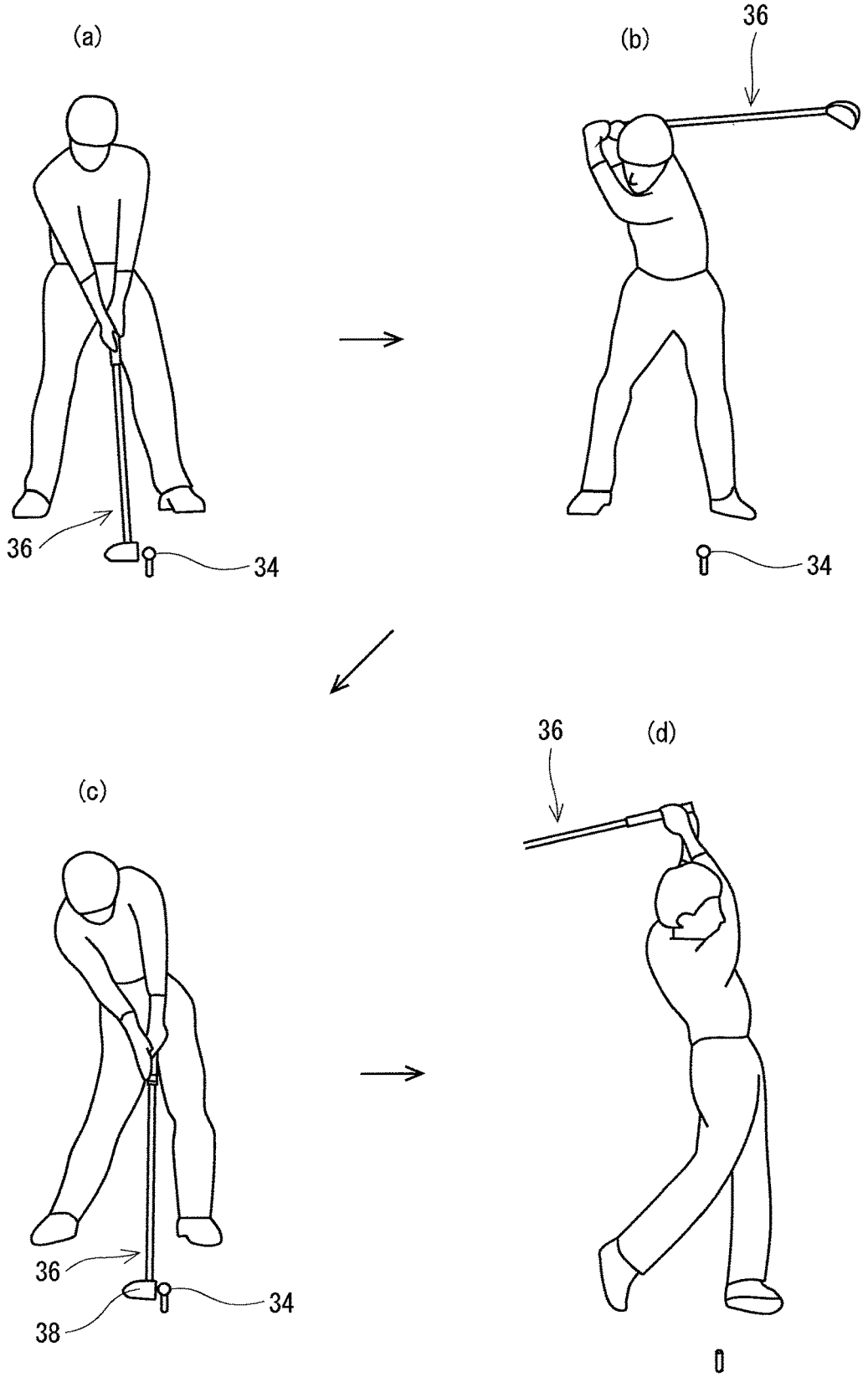
FIG. 4 is an illustration of a swing position.

FIG. 4 shows each position in which the golf player (subject) swings the golf club 36. The position of (a) of FIG. 4 is an address. The position of (b) of FIG. 4 is a top of swing (hereinafter, referred to as a top). The position of (c) of FIG. 4 is an impact. The impact is a position of a moment when the head 38 and the ball 34 collide with each other. The position of (d) of FIG. 4 is a finish. The golf player's swing is continuously transferred from the address to the top, from the top to the impact, and from the impact to the finish. The swing is ended in the finish.

An impact condition is measured in the apparatus 2. The impact condition is a measurement value at impact and/or near the impact. When a position separated backward by 13 cm from the center of a ball before being hit is defined as P1, "near the impact" means from the position P1 to an impact position.

Examples of the impact condition include a head speed, a face angle, a shaft angle, a lie angle, a dynamic loft, an entering angle, a blow angle, a lateral hit point, and a vertical hit point. Another examples of the impact condition include face rotation.

The face angle is direction of a face near the impact. The face angle employed in examples of the present application is an angle between a face normal direction and a target direction. The face normal direction is a direction of a projection line obtained by projecting the normal line of the face surface at a face center on a level surface (ground). In examples to be described later, when the face normal direction is on the right side of the target direction, the face angle is a positive value, and when the face normal direction is on the left side of the target direction, the face angle is a negative value.

The shaft angle is an angle of the shaft near the impact. The shaft angle can be measured based on the posture of the shaft at impact and a vertical line. In respect of avoiding the influence of the flexure of the shaft, preferably, the shaft angle can be obtained based on the image of the tip part of the shaft. In examples to be described later, when the shaft axis is inclined forward of a vertical direction, the shaft angle is a negative value, and when the shaft axis is inclined backward of the vertical direction, the shaft angle is a positive value. In other words, in the present application, the shaft angle is a negative value in a so-called handfast state.

The lie angle is a lie angle of the head near the impact. In other words, the lie angle is a dynamic lie angle. The lie angle can be determined based on the posture of the head at impact and the level surface.

The dynamic loft is a loft of the face surface at impact.

The dynamic loft is an angle to the vertical line. The dynamic loft may be directly measured by the posture of the face surface, for example. The dynamic loft can also be calculated based on the real loft angle of the head and the shaft angle.

The entering angle means an incidence angle of the head in a horizontal direction. In examples to be described later, the entering angle in the case of so-called inside-out is a positive value, and the entering angle in the case of so-called outside-in is a negative value.

The blow angle means an incidence angle of the head in the vertical direction. In examples to be described later, the blow angle in the case of so-called down blow is a negative value, and the blow angle in the case of so-called upper blow is a positive value.

The lateral hit point is a hit point position in a toe-heel direction. In the present application, the lateral hit point is a distance from the face center. In examples to be described later, the lateral hit point in the case of being on the toe side of the face center is a negative value, and the lateral hit point in the case of being on the heel side of the face center is a positive value. In examples to be described later, the face center is a center of figure of the face surface.

The vertical hit point is a hit point position in a top-sole direction. In the present application, the vertical hit point is a distance from the face center. In examples to be described later, the vertical hit point in the case of being on the top side of the face center is a positive value, and the vertical hit point in the case of being on the sole side of the face center is a negative value.

The three-dimensional posture of the head may be obtained based on the images of a plurality of cameras. The impact condition may be calculated from the three-dimensional posture.

The head speed, the entering angle, and the blow angle can be analyzed based on the head images at two times and/or the shaft images at two times. In order to obtain the images at two times at impact, for example, flash light is emitted twice at a predetermined interval. The methods described in Japanese Patent Application Laid-Open Nos. 7-227453 and 2004-24488 described above may be employed.

Figure 5:
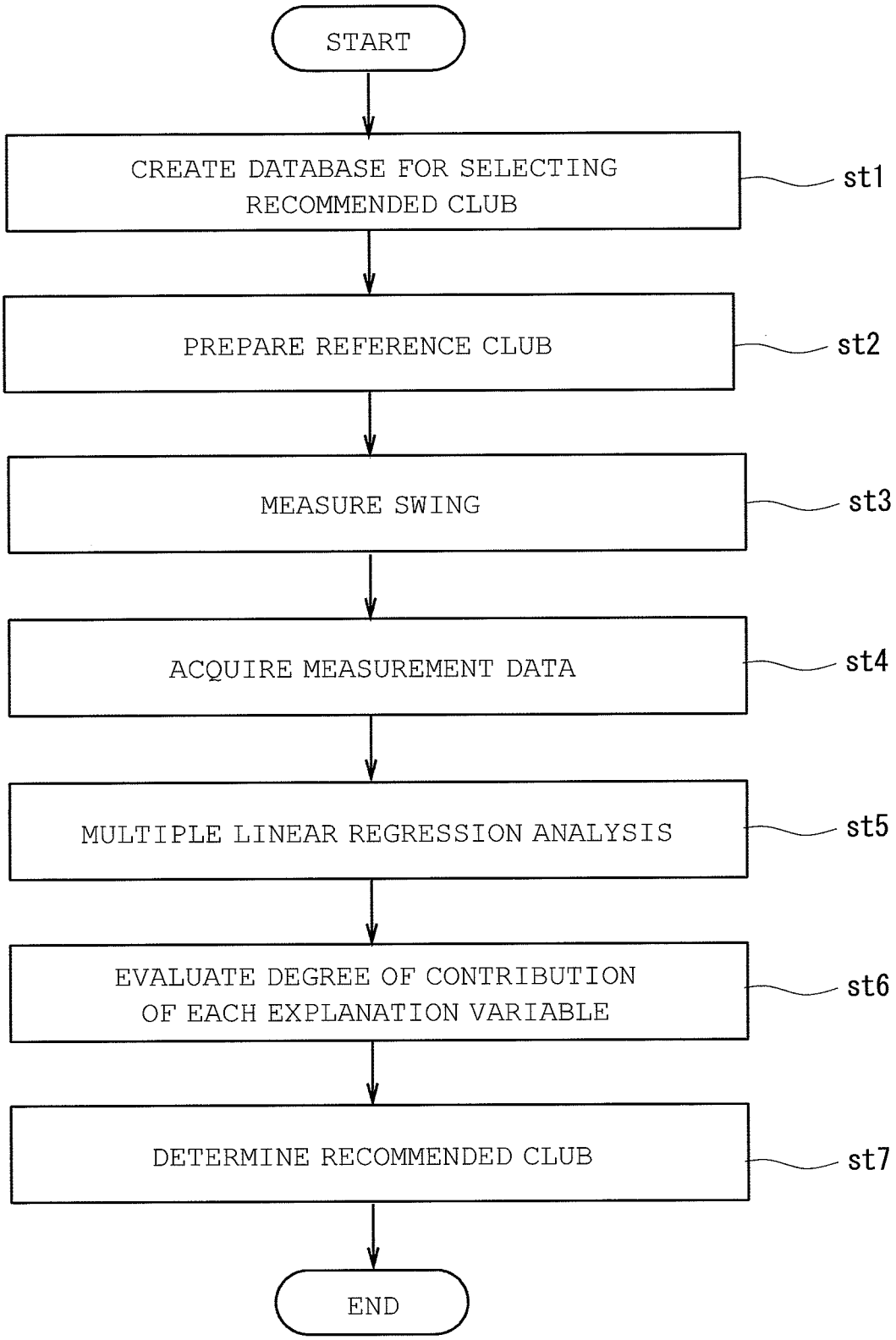
FIG. 5 is a flowchart showing an example of a fitting method according to the present invention.

FIG. 5 shows an example of the procedure of the fitting method according to the present invention. As shown in FIG. 5, the procedure includes the following steps:

(1) a step st1 of creating the database for selecting the recommended club;

(2) a step st2 of preparing the reference club;

(3) a step st3 of measuring the subject's swing using the reference club;

(4) a step st4 of acquiring the impact condition as the measurement data;

(5) a step st5 of performing multiple linear regression analysis;

(6) a step st6 of evaluating the degree of contribution of each explanation variable; and (7) a step st7 of determining the recommended club having a specification capable of suppressing variation.

As for the step st1, an example of the database for selecting the recommended club will be described later. The database for selecting the recommended club may not exist.

As for the step st2, the reference club is not particularly limited. For example, a club usually used by the subject may be the reference club. A club included in the database for selecting the recommended club may be the reference club.

In three examples to be described later, the shaft length of the reference club is substantially equal to that of the recommended club. "Substantially equal" means allowing the difference of ±2%.

The details of the step st5 to the step st7 will be described later.

Next, the detail of a preferred fitting method will be described.

Figure 6:
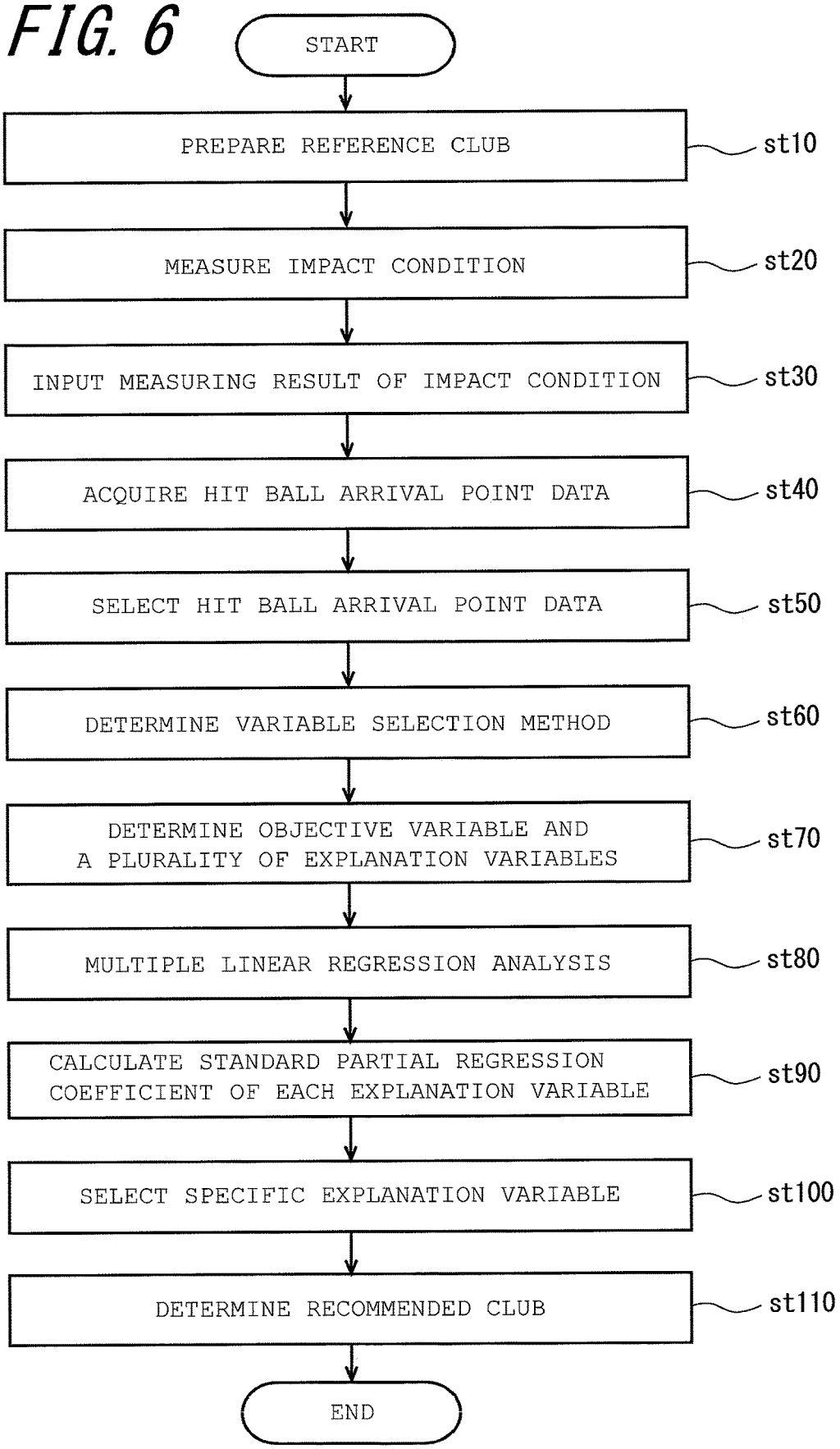
FIG. 6 is a flow chart showing an example of the fitting method according to the present invention.

FIG. 6 shows an example of the fitting method according to the embodiment. A step st10 is the same as the above-mentioned step st2.

In a step st20, a plurality of impact conditions are measured using the reference club. The step st20 is the above-mentioned step A1. In respect of fitting accuracy, the number of kinds of the impact conditions to be measured is preferably equal to or greater than 3, more preferably equal to or greater than 4, and still more preferably equal to or greater than 5. In respect of simplification of data processing, the number of kinds of impact conditions to be measured is preferably equal to or less than 8. Seven kinds of impact conditions are measured in examples to be described later.

In a step st30, the measured impact conditions are input into the information processor 12.

In a step st40, hit ball arrival point data is acquired. This is the above-mentioned step B1. Examples of the hit ball arrival point data include a flight distance and lateral deviation. Examples of the flight distance include total and carry. The carry is a distance between a hit ball point and a first ball landing point. The flight distance in examples to be described later is the carry. The total is a distance between a hit ball point and a final arrival point of the ball. The lateral deviation shows the stability of a hit ball direction. When a straight line connecting the hit ball point and a target point is a target line, the lateral deviation in the carry is a distance between the target line and the ball landing point. The lateral deviation in the total is a distance between the target line and the final arrival point. Other examples of the hit ball arrival point data include run. The run is a value obtained by subtracting the carry from the total.

The hit ball arrival point data may be acquired by actual measurement, or may be acquired by a simulation. In the case of the simulation, for example, a trajectory equation is used. In the trajectory equation, ball initial velocity, a launch angle, and a spin are input variables. The flight distance and the lateral deviation can be calculated by inputting the ball initial velocity, the launch angle, a backspin, and a side spin in the trajectory equation. The trajectory equation can be created by the actual measurement, the simulation, or the combination thereof. A highly accurate trajectory equation can be created by using a large number of actual measurement data.

In a step st50, the hit ball arrival point data is selected. When a plurality of hit ball arrival point data are acquired, one hit ball arrival point data is selected. Naturally, when the number of the acquired hit ball arrival point data is one, the selection of the hit ball arrival point data is not needed. Since the hit ball arrival point data is only the carry in examples to be described later, the step st50 is not needed.

In a step st60, a variable selection method is determined. In the variable selection method, a good regression model can be searched by narrowing down the explanation variables. A variable selection method to be used may be selected from a plurality of variable selection methods. A known variable selection method can be used. Examples of the variable selection method include a stepwise forward selection method, a stepwise backward selection method, a forward selection method, a backward selection method, and sequential selection of the four methods. In examples to be described later, the variable increasing method is used.

Variable selection may not be performed. However, in respect of determining an explanation variable having a high degree of contribution to the variation with accuracy, the variable selection is preferably performed.

In a step st70, an objective variable and a plurality of explanation variables are determined. The objective variable is the hit ball arrival point data. The plurality of explanation variables are preferably selected by the variable selection method.

In a step st80, multiple linear regression analysis is performed. The multiple linear regression analysis itself is known. A multiple regression equation has a plurality of products of the explanation variables and partial regression coefficients. The multiple regression equation is expressed by the sum of the plurality of products and a constant term. In the multiple regression equation, the partial regression coefficient is determined for each explanation variable. The partial regression coefficient independent of a unit is a standard partial regression coefficient.

The step st70 and the step st80 are the above-mentioned step C1.

The standard partial regression coefficient is calculated for each explanation variable based on the multiple linear regression analysis (step st90). The step st90 is useful to determine the specific explanation variable of the above-mentioned step D1.

In a step st100, the specific explanation variable is selected. The step st100 is the above-mentioned step D1. It can be considered that the greater the absolute value of the standard partial regression coefficient is, the higher the degree of contribution to the objective variable (hit ball arrival point data) is. The explanation variable having the greatest standard partial regression coefficient may be the above-mentioned specific explanation variable. The variation in the specific explanation variable can be said to be the primary cause of the variation in the objective variable.

In a step st110, the recommended club is determined. The recommended club has a specification capable of suppressing the variation in the specific explanation variable. Preferably, the recommended club is selected from the above-mentioned recommended club database. The selection is performed by a program, for example. The selection may be performed by a fitter. The step st110 is the above-mentioned step E1.

Specification Capable of Suppressing Variation

In the above-mentioned step st7 and step st110, a specification suppressing the variation in the specific explanation variable is determined. Examples of a specification determination reference include the following items:

(1a) increasing or decreasing a club weight as compared to that of the reference club when the specific explanation variable is the head speed;

(1b) increasing or decreasing a shaft weight as compared to that of the reference club when the specific explanation variable is the head speed;

(1c) increasing or decreasing a head weight as compared to that of the reference club when the specific explanation variable is the head speed;

(1d) increasing or decreasing a swingweight as compared to that of the reference club when the specific explanation variable is the head speed;

(2a) decreasing (hardening) a flex as compared to that of the reference club when the specific explanation variable is the face angle;

(2b) decreasing a low flex point rate as compared to that of the reference club when the specific explanation variable is the face angle;

(2c) decreasing a shaft torque as compared to that of the reference club when the specific explanation variable is the face angle;

(3a) decreasing the flex as compared to that of the reference club when the specific explanation variable is the dynamic loft;

(3b) decreasing the low flex point rate as compared to that of the reference club when the specific explanation variable is the dynamic loft;

(3c) decreasing the shaft torque as compared to that of the reference club when the specific explanation variable is the dynamic loft;

(3d) shallowing the depth of the center of gravity of the head as compared to that of the reference club when the specific explanation variable is the dynamic loft;

(4a) decreasing the flex as compared to that of the reference club when the specific explanation variable is the lie angle;

(4b) decreasing the distance of the gravity center of the head as compared to that of the reference club when the specific explanation variable is the lie angle;

(5a) increasing or decreasing the club weight as compared to that of the reference club when the specific explanation variable is the entering angle;

(5b) increasing or decreasing the shaft weight as compared to that of the reference club when the specific explanation variable is the entering angle; (5*c*) increasing or decreasing the head weight as compared to that of the reference club when the specific explanation variable is the entering angle;

(5d) increasing or decreasing the swingweight as compared to that of the reference club when the specific explanation variable is the entering angle;

(6a) increasing or decreasing the club weight as compared to that of the reference club when the specific explanation variable is the blow angle;

(6b) increasing or decreasing the shaft weight as compared to that of the reference club when the specific explanation variable is the blow angle;

(6c) increasing or decreasing the head weight as compared to that of the reference club when the specific explanation variable is the blow angle;

(6d) increasing or decreasing the swingweight as compared to that of the reference club when the specific explanation variable is the blow angle;

(7a) increasing a lateral moment of inertia as compared to that of the reference club when the specific explanation variable is the lateral hit point;

(7b) decreasing the flex as compared to that of the reference club when the specific explanation variable is the lateral hit point;

(8a) increasing a vertical moment of inertia as compared to that of the reference club when the specific explanation variable is the vertical hit point;

(8b) decreasing the flex as compared to that of the reference club when the specific explanation variable is the vertical hit point;

(9a) decreasing the flex as compared to that of the reference club when the specific explanation variable is the shaft angle;

(9b) decreasing the low flex point rate as compared to that of the reference club when the specific explanation variable is the shaft angle; and (9c) shallowing the depth of the center of gravity of the head as compared to that of the reference club when the specific explanation variable is the shaft angle.

In these specification determination references, the variation in the specific explanation variable is considered to be suppressed. For example, when the specific explanation variable is the head speed, since the club cannot be effectively used, the head speed may vary. In other words, since the club weight or the like is not adapted to the golf player, the head speed may vary. In this case, the variation in the head speed can be suppressed by adjusting the club weight or the like. As a result, the variation in the objective variable can be suppressed.

The lateral moment of inertia is a moment of inertia around a vertical axis line passing through the center of gravity of the head. The head is set to a reference state in the measurement of the lateral moment of inertia. In the reference state, the head is placed on the level surface at a predetermined lie angle and real loft angle. The predetermined lie angle and real loft angle are described, for example, in a product catalog.

The vertical moment of inertia is a moment of inertia around a level axis line passing through the center of gravity of the head. The head is set to the reference state in the measurement of the vertical moment of inertia.

The low flex point rate is calculated as follows, for example. When the low flex point rate is defined as C1; a forward flex (mm) is defined as F1; and a backward flex (mm) is defined as F2, the low flex point rate C1 can be calculated by the following formula:

$$C1=[F2/(F1+F2)]\times 100$$

As described above, in the embodiment, the database for selecting the recommended club may be used. For example, data such as a plurality of clubs, a plurality of shafts, a plurality of heads are registered into the database. Preferably, a plurality of clubs having different specific explanation variable are registered as recommended club candidates into the database. Software (or fitter) may select the recommended club from the recommended club candidates based on the specification determination reference.

Embodiment According to Second Aspect of the Present Invention

The above-mentioned fitting apparatus 2 can be used also for an apparatus capable of being used for a fitting method of the second aspect.

As described above, the memory 28 is a rewritable memory. The hard disk 32 stores a program and data or the like. A program for executing each step to be described later is stored. A hit ball result database to be described later is stored. The memory 28 constitutes a storing area and a working area or the like for a program and measurement data or the like read from the hard disk 32.

In the apparatus 2, the head speed, the dynamic loft, and the blow angle near the impact are measured.

"Near the impact" in the present application means a position where the head and the ball are brought into contact with each other and a position near it. When a position separated backward by 13 cm from the center of the ball before being hit is defined as P1, "near the impact" means from the position P1 to the impact position.

The blow angle means a vertical incidence angle. In the present application, the blow angle in the case of so-called down blow is a negative value, and the blow angle in the case of being so-called upper blow is a positive value.

The head speed, the dynamic loft, and the blow angle can be analyzed based on the head images at two times and/or the shaft images at two times. In order to obtain the images at two times at impact, for example, flash light is emitted twice at a predetermined interval. The methods described in Japanese Patent Application Laid-Open Nos. 7-227453 and 2004-24488 described above may be employed.

The dynamic loft (dynamic loft) is a loft of the face surface at impact. The dynamic loft is an angle to the vertical line. The dynamic loft may be directly measured by the posture of the face surface, for example. The dynamic loft can also be calculated based on the angle of a hosel or shaft based on the real loft angle of the head. In order to avoid the influence of the flexure of the shaft when being based on the angle of the shaft, the dynamic loft can be obtained based on the image of the tip part of the shaft. The three-dimensional posture of the head may be obtained based on the images of the plurality of cameras. The dynamic loft can be calculated also from the three-dimensional posture.

Figure 7:
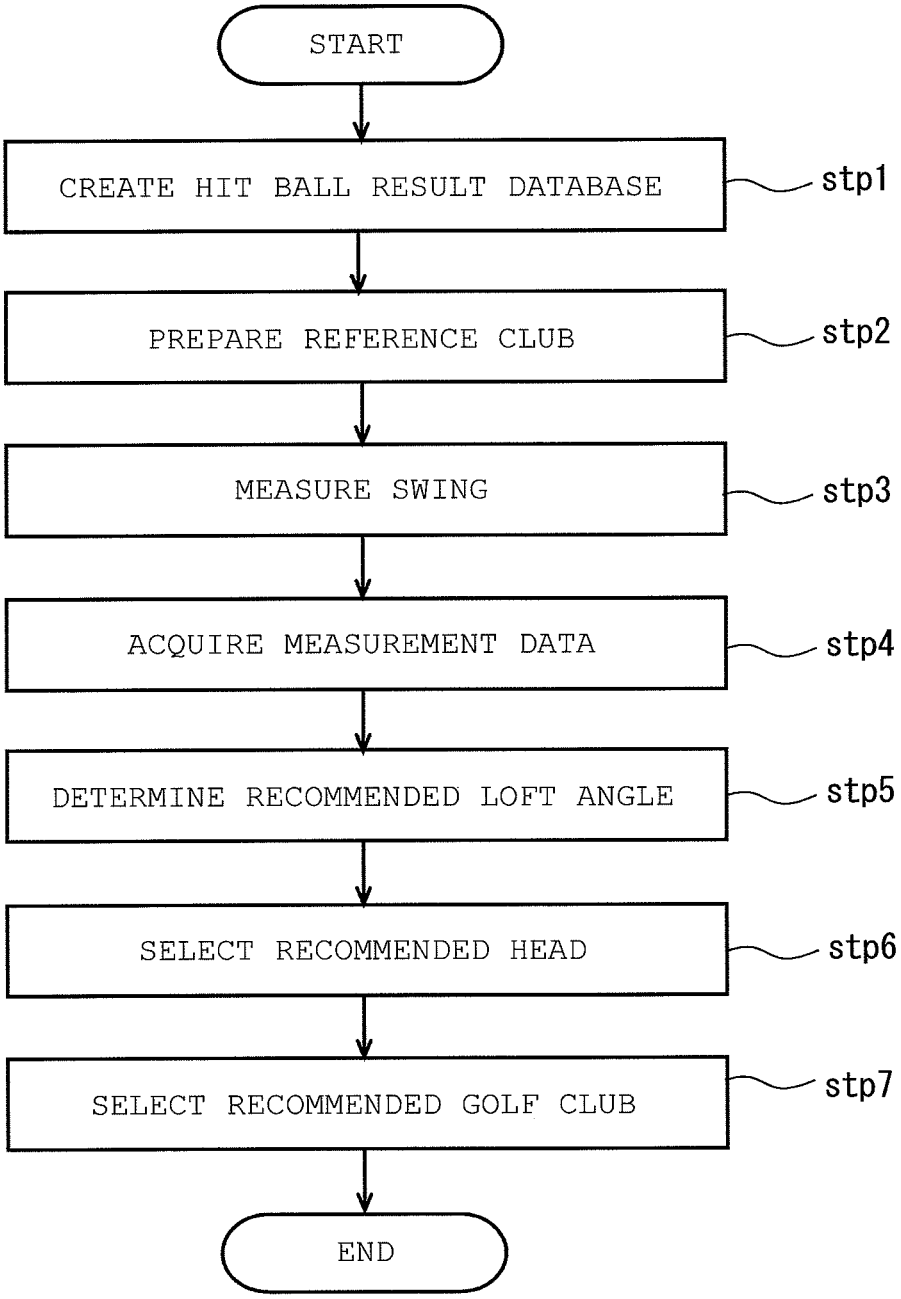
FIG. 7 is a flow chart showing an example of the fitting method according to the present invention.

FIG. 7 shows an example of the procedure of the fitting method according to the present invention. As shown in FIG. 7, the procedure includes the following steps:

(1) a step stp1 of creating the hit ball result database;

(2) a step stp2 of preparing the reference club;

(3) a step stp3 of measuring the subject's swing using the reference club;

(4) a step stp4 of acquiring the head speed, the dynamic loft, and the blow angle as measurement data;

(5) a step stp5 of determining the recommended loft angle;

(6) a step stp6 of selecting the recommended head based on the recommended loft angle; and (7) a step stp7 of selecting the recommended club based on the recommended loft angle or the recommended head.

As for the step stp1, an example of the hit ball result database will be described later.

As for the step stp2, the reference club is not particularly limited. For example, a club usually used by the subject may be the reference club. A club used for producing the hit ball result database may be the reference club. In the embodiment, the recommended loft angle is determined based on the blow angle. The blow angle is hardly changed by a club specification. Therefore, the reduction in the fitting accuracy due to the difference between the specifications of the reference club and recommended club can be suppressed by using the blow angle.

In respect of further improving the fitting accuracy, the shaft product class of the reference club may be the same as that of the recommended club. The typical example of the shaft product class is a product name of the shaft. Preferably, in addition to the shaft product class, the shaft flex may also be the same. The shaft flex is indicated by signs such as "X", "S", "SR", and "R", for example.

In respect of further improving the fitting accuracy, the shaft length of the reference club may be substantially equal to that of the recommended club. "Substantially equal" means allowing the difference of ±2%.

In respect of further improving the fitting accuracy, the shaft weight of the reference club may be substantially equal to that of the recommended club. "Substantially equal" means allowing the difference of ±2%.

In respect of the fitting accuracy, the club number of the reference club may be the same as that of the recommended club. For example, when the reference club is a driver (No. 1 wood), the recommended club is also preferably a driver.

In respect of further improving the fitting accuracy, the club length of the reference club may be substantially equal to that of the recommended club. "Substantially equal" means allowing the difference of ±2%.

In respect of further improving the fitting accuracy, the club weight of the reference club may be substantially equal to that of the recommended club. "Substantially equal" means allowing the difference of ±2%.

In respect of further improving the fitting accuracy, the club product class of the reference club may be made the same as that of the recommended club. The typical example of the club product class is a product name of the club.

The details of the step stp3 to the step stp5 will be described later.

As for the step stp6, there is a limit to the variation of the loft angle of the head. For example, in the case of the driver, typical loft variation is an interval of 0.5 degree or 1.0 degree. These loft variations are referred to as recommended loft angle candidates. Preferably, the recommended loft angle is selected from these recommended loft angle candidates. The head having the recommended loft angle is the recommended head.

As for the step stp7, an example of the recommended club is the golf club having the recommended head. Other example of the recommended club is a golf club having the recommended loft angle. The recommended club may be selected without selecting the recommended head. After the recommended head is selected, the recommended club may be obtained by replacing the head of the reference club with the recommended head.

Next, the details of the step stp3 to the step stp5 will be described.

Figure 8:
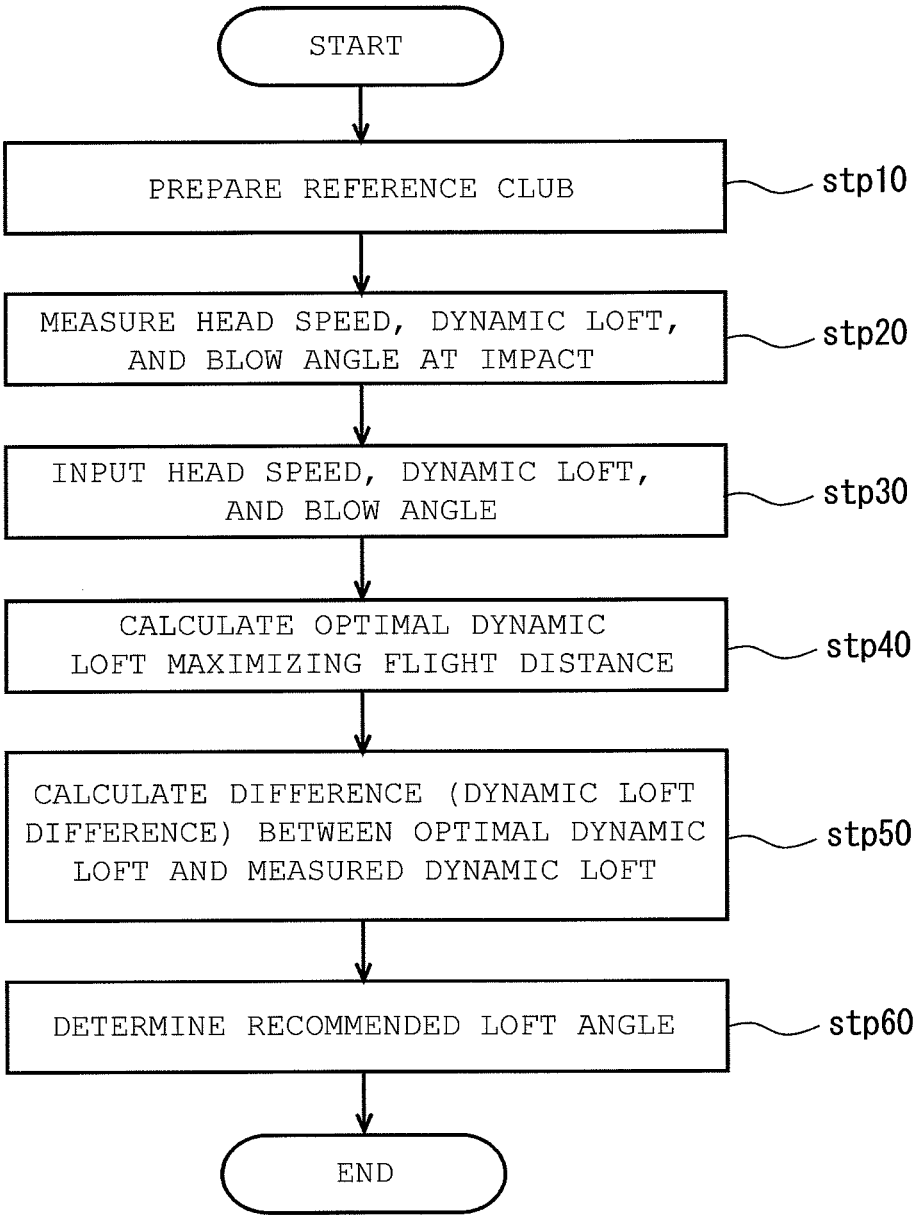
FIG. 8 is a flow chart showing an example of the fitting method according to the present invention.

FIG. 8 shows an example of the fitting method according to the embodiment. A step stp10 is the same as the above-mentioned step stp2.

In a step stp20, the subject's head speed, dynamic loft, and blow angle are measured by using the reference club. In respect of the fitting accuracy, a plurality of measurements, is preferably performed. Preferably, the head speed, the dynamic loft, and the blow angle are the average value of a plurality of measurement values.

In a step stp30, the head speed, the dynamic loft, and the blow angle are input into the information processor 12.

In a step stp40, the calculating part (CPU 30) calculates an optimal dynamic loft maximizing the flight distance according to the program. Alternatively, the calculating part (CPU 30) calculates a suitable dynamic loft according to the program. The flight distance is a preferred example of the hit ball result. The optimal dynamic loft is an example of the suitable dynamic loft. The optimal dynamic loft and the suitable dynamic loft can be judged according to a flight distance prediction map to be described later, for example.

A suitable dynamic loft Lf may not be a specific numerical value, and may be within a numerical value range, for example. Examples of the suitable dynamic loft Lf include the following items Lf1 and Lf2.

[Lf1] a loft angle greater than a measured dynamic loft Lm

[Lf2] a loft angle less than the measured dynamic loft Lm

The degree of the difference between the suitable dynamic loft Lf1 and the dynamic loft Lm can be judged based on the loft angle range of the recommended loft angle candidate, for example. The degree of the difference between the suitable dynamic loft Lf2 and the dynamic loft Lm can be judged based on the loft angle range of the recommended loft angle candidate, for example. When the options of the recommended loft angle candidate are limited, the suitable dynamic loft Lf can be judged in consideration of the options. For example, when the difference between the maximum value and minimum value of the loft angle of the recommended loft angle candidate is defined as X degrees, the absolute value of the difference between the suitable dynamic loft Lf1 and the dynamic loft Lm can be set to X degrees or less. Similarly, the absolute value of the difference between the suitable dynamic loft Lf2 and the dynamic loft Lm can be set to X degrees or less.

Of course, an optimal dynamic loft Lx may be decided to one value based on the hit ball result database. When the optimal dynamic loft Lx exhibiting the best hit ball result is determined by the hit ball result database, the optimal dynamic loft Lx is preferably employed.

In a step stp50, a difference between the optimal dynamic loft (or the suitable dynamic loft) and the measured dynamic loft Lm is calculated. The difference is a dynamic loft difference.

A dynamic loft difference Ld may not be a specific numerical value, and may be within a numerical value range, for example.

Examples of the dynamic loft difference Ld include the following items Ld1 and Ld2.

[Ld1] positive value

[Ld2] negative value

A preferred dynamic loft difference Ld1 is greater than 0 degree and X degrees or less, for example. A preferred dynamic loft difference Ld2 is −X degrees or greater and less than 0 degree, for example.

When the dynamic loft difference Ld is a positive value, the hit ball result can be improved by making the dynamic loft greater than the measured dynamic loft Lm. In this case, a loft angle greater than the loft angle Ls of the reference club can be defined as a recommended loft angle Lr. Preferably, the recommended loft angle Lr is selected from the recommended loft angle candidates. When a plurality of loft angles greater than the loft angle Ls exist in the recommended loft angle candidates, a recommended loft angle having a better hit ball result can be narrowed down based on the hit ball result database.

When the dynamic loft difference Ld is a negative value, the hit ball result can be improved by making the dynamic loft less than the measured dynamic loft Lm. In this case, a loft angle less than the loft angle Ls of the reference club can be defined as the recommended loft angle Lr. Preferably, the recommended loft angle Lr is selected from the recommended loft angle candidates. When a plurality of loft angles less than the loft angle Ls exist in the recommended loft angle candidates, a recommended loft angle having a better hit ball result can be narrowed down based on the hit ball result database.

A specific numerical value of the dynamic loft difference Ld may be obtained. An example of a calculating method of the specific numerical value is as follows. When the optimal dynamic loft is defined as Lx (degree), and the measured dynamic loft is defined as Lm (degree), a preferred dynamic loft difference Ld (degree) is calculated by the following formula (F1). The dynamic loft difference Ld may also be a positive value, and may also be a negative value.

$$Ld=Lx-Lm \quad \text{(F1)}$$

In a step stp60, the recommended loft angle is determined.

The recommended loft angle is determined based on the loft angle of the reference club and the dynamic loft difference. Preferably, the recommended loft angle Lr is selected from the recommended loft angle candidates.

The recommended loft angle Lr may be calculated by a numerical expression. An example of the calculating method is as follows. When the recommended loft angle is defined as Lr and the loft angle of the reference club is defined as Ls, the recommended loft angle Lr can be calculated by the following formula (F2).

$$Lr=Ls+Ld \quad \text{(F2)}$$

When the suitable dynamic loft Lf (or the optimal dynamic loft Lx) is greater than the dynamic loft Lm, the dynamic loft Lm is brought close to the optimal dynamic loft Lx by increasing the loft angle Ls. Therefore, the improvement of the flight distance (hit ball result) can be expected. On the other hand, when the suitable dynamic loft Lf (or the optimal dynamic loft Lx) is less than the dynamic loft Lm, the dynamic loft Lm is brought close to the optimal dynamic loft Lx by decreasing the loft angle Ls. Therefore, the improvement of the flight distance (hit ball result) can be expected.

Examples of the hit ball result include the stability of the flight distance and hit ball direction. A preferred hit ball result is the flight distance. Examples of the flight distance include total and carry. The carry is a distance between the hit ball point and the first ball landing point. The flight distance in examples to be described later is the total. The total is a distance between the hit ball point and the final arrival point of the ball. The hit ball result particularly emphasized by an amateur golf player is a total flight distance. In this respect, the hit ball result is more preferably the total flight distance.

As described above, the fitting method of the embodiment includes the following step A2, step B2, step C2, and step D2.

(A2) a step of measuring the subject's head speed, dynamic loft Lm, and blow angle using the reference club;

(B2) a step of determining the suitable dynamic loft Lf predicted that the hit ball result is good based on the measured head speed and the measured blow angle;

(C2) a step of obtaining the dynamic loft difference Ld calculated from the suitable dynamic loft Lf and the measured dynamic loft Lm; and (D2) a step of determining the recommended loft angle Lr based on the loft angle Ls of the reference club and the dynamic loft Lm.

The step stp20 corresponds to the step A. The step stp40 is an example of the step B2. The step stp50 is an example of the step C2. The step stp60 corresponds to the step D2.

The head speed and the blow angle depend on the golf player's swing. On the other hand, the head speed and the blow angle are hardly influenced by club specifications such as the rigidity distribution of the shaft and the position of the center of gravity of the head. Therefore, in the step B2, the suitable dynamic loft Lf reflecting the feature of each golf player's swing and suppressing the influence of other elements can be obtained.

In all the club specifications, the loft angle particularly greatly influences the hit ball result. A hit ball initial condition mainly determines the hit ball result, particularly the flight distance. The main hit ball initial conditions are the ball initial velocity, the launch angle, and the backspin. The flight distance is mostly determined according to the three conditions. The dynamic loft is directly involved in the determination of these hit ball initial conditions. Naturally, the dynamic loft is greatly influenced by the loft angle of the club. Therefore, the consideration of the loft angle and dynamic loft of the club is effective for attaining the optimization of the hit ball initial condition.

In the embodiment, the recommended loft angle greatly influencing the hit ball result is determined by using the head speed and the blow angle which are hardly influenced by other specification. Therefore, effective and highly accurate fitting is enabled. In this respect, the step B2 preferably determines the suitable dynamic loft Lf predicted that the hit ball result is good based on only the measured head speed and the measured blow angle.

In the prediction in the step B2, the hit ball results in the dynamic lofts in the measured blow angle are compared by using the hit ball result database. The hit ball result database is the flight distance prediction map, for example. The flight distance prediction map (FIG. 12 or the like) is a contour line map. The contour line map is searched on the straight line of the measured blow angle, and the dynamic loft having a good flight distance is determined as the suitable dynamic loft. Preferably, the contour line map is searched on the straight line of the measured blow angle, and the dynamic loft having the best flight distance is determined as the optimal dynamic loft. The optimal dynamic loft and the suitable dynamic loft may be determined as one value, and may be within a numerical value range.

Other example of a good hit ball result is a standard hit ball result set for each head speed. The standard hit ball result can be statistically determined based on many hit ball results, for example.

Based on the hit ball result database, a dynamic loft predicted that a hit ball result is better than that of the reference club may be the suitable dynamic loft.

[Hit Ball Result Database]

Preferably, in the prediction in the step B2, the hit ball result database is used. The hit ball result database is a database capable of predicting the hit ball result based on the dynamic loft and the blow angle. An example of the hit ball result database is a flight distance prediction map to be described later. The hit ball result database may not be a map. For example, the hit ball result database may be a list (table). One capable of predicting the hit ball result based on the dynamic loft and the blow angle can be employed as the hit ball result database.

The hit ball result database can be created by the actual measurement, the simulation, or the combination thereof, for example. For example, the highly accurate hit ball result database can be created by performing statistical processing using a large number of actual measurement data. The hit ball result database can be created by combining the actual measurement with the simulation without needing the large number of actual measurement data.

In the actual measurement for constructing the hit ball result database, a swing robot can be suitably used. Since the swing robot enables a precise shot having high reproducibility, the swing robot can improve the reliability of the data.

An example of the hit ball result database is a flight distance prediction map to be described later. The flight distance prediction map can be created based on ball initial velocity prediction data, launch angle prediction data, and backspin prediction data, for example.

The ball initial velocity prediction data is data capable of predicting the ball initial velocity based on the dynamic loft and the blow angle. Preferably, the ball initial velocity prediction data is created for each head speed. An example of the ball initial velocity prediction data is a ball initial velocity prediction map to be described later. The ball initial velocity prediction data can be created by the actual measurement, the simulation, or the combination thereof.

The launch angle prediction data is data capable of predicting the launch angle based on the dynamic loft and the blow angle. Preferably, the launch angle prediction data is created for each head speed. An example of the launch angle prediction data is a launch angle prediction map to be described later. The launch angle prediction data can be created by the actual measurement, the simulation, or the combination thereof.

The backspin prediction data is data capable of predicting a backspin based on the dynamic loft and the blow angle. Preferably, the backspin prediction data is created for each head speed. An example of the backspin prediction data is a backspin prediction map to be described later. The backspin prediction data can be created by the actual measurement, the simulation, or the combination thereof.

The flight distance prediction map can be created based on the ball initial velocity prediction map, the launch angle prediction map, and the backspin prediction map, for example. In this case, the flight distance prediction map can be created by the simulation, for example. For example, a trajectory equation is used for the simulation. In the trajectory equation, the ball initial velocity, the launch angle, and the backspin are variables. In the trajectory equation, the flight distance can be calculated by inputting the ball initial velocity, the launch angle, and the backspin. The trajectory equation can be created by the actual measurement, the simulation, or the combination thereof.

The flight distance prediction map is an example of correlation data between the dynamic loft and the blow angle created for each head speed. The suitable dynamic loft Lf can be determined by the flight distance prediction map. The optimal dynamic loft Lx can be determined by the flight distance prediction map.

Frequently, the head speed (set head speed) set in the hit ball result database (flight distance prediction map) does not coincide with the measured head speed. In this case, the hit ball result database of the set head speed nearest to the measured head speed is preferably used.

EXAMPLES

Hereinafter, the effects of the present invention will be clarified by examples. However, the present invention should not be interpreted in a limited way based on the description of the examples.

Test According to First Aspect of the Present Invention

Example 1 and Comparative Example 1

A reference club A was prepared. The reference club A was a driver. A tester A hit a ball eight times. In these hits, an impact condition and hit ball arrival point data were measured. As the impact condition, a head speed, a face angle, a shaft angle, an entering angle, a blow angle, a lateral hit point, and a vertical hit point were measured. Carry was measured as the hit ball arrival point data. These measuring results are shown in the following Table 1.

TABLE 1

Measurement data of tester A using reference club

| Tester | Flex | Head speed (H/S) m/s | Face angle degree | Shaft angle degree | Entering angle degree | Blow angle degree | Lateral hit point mm | Vertical hit point mm | Carry yard |
|---|---|---|---|---|---|---|---|---|---|
| A | Reference | 43.3 | 3.0 | −1.9 | 2.1 | 0.7 | 7.3 | 9.5 | 175 |
| A | Reference | 43.3 | 3.3 | −2.1 | 2.7 | 1.2 | 12.4 | 12.2 | 173 |
| A | Reference | 44.0 | 4.8 | −1.3 | 1.9 | 0.7 | 1.1 | 0.9 | 211 |

TABLE 1-continued

| Measurement data of tester A using reference club | | | | | | | | | |
|---|---|---|---|---|---|---|---|---|---|
| Tester | Flex | Head speed (H/S) m/s | Face angle degree | Shaft angle degree | Entering angle degree | Blow angle degree | Lateral hit point mm | Vertical hit point mm | Carry yard |
| A | Reference | 43.7 | 4.4 | 0.2 | 1.5 | 1.6 | 12.1 | −2.0 | 222 |
| A | Reference | 44.6 | 3.9 | −2.4 | 1.9 | 0.3 | −9.8 | 4.5 | 192 |
| A | Reference | 44.2 | 8.9 | −3.0 | 2.3 | −0.3 | −1.4 | 14.7 | 198 |
| A | Reference | 43.3 | 6.4 | −2.0 | 3.0 | 0.7 | 15.9 | −4.5 | 210 |
| A | Reference | 43.0 | 3.6 | −2.0 | 1.5 | 0.8 | 18.2 | 6.4 | 167 |
| | | | σ = 1.0 | | | | | σ = 20.3 | |

Since the data of Table 1 are hit ball results before fitting, the data are considered to be comparative example (comparative example 1).

These measurement data were input into an information processor 12 (computer). A forward selection method was employed as a variable selection method. Software conducted the forward selection method using the measurement data. As the software, "JUSE-StatWorks" (trade name) of The Institute of Japanese Union of Scientists & Engineers was used. A variance ratio was used as variable selection reference. A predetermined boundary variance ratio was set. In the embodiment, the boundary variance ratio was set to 2. The forward selection method starts from a regression expression of only a constant term excluding explanation variables, and increases an explanation variable one by one for each step. The variance ratio calculated in each step is shown in the following Table 2.

As shown in Table 2, the selected explanation variables were the vertical hit point, the face angle, the shaft angle, the lateral hit point, and the entering angle in the order of steps. Other explanation variables were not selected because all the variance ratios were equal to or less than the boundary variance ratio. That is, the head speed and the blow angle were not selected. Next, multiple linear regression analysis was conducted therefor, and a standard partial regression coefficient was calculated for each of the explanation variables selected by the variable selection method. The software ("JUSE-StatWorks" (trade name), The Institute of Japanese Union of Scientists & Engineers) conducted the multiple linear regression analysis and calculated the standard partial regression coefficient. The results are shown in the following Table 3.

TABLE 2

| Variance ratio (tester A) | | | | | | | | |
|---|---|---|---|---|---|---|---|---|
| | Variance ratio | | | | | | | |
| Step | Constant term | H/S | Face angle | Shaft angle | Entering angle | Blow angle | Lateral hit point | Vertical hit point |
| In the case of selecting only constant term | 728.5497 | 1.3762 | 1.6677 | 2.3704 | 0.0009 | 0.0742 | 0.186 | 5.0119 |
| After selecting vertical hit point | 762.3239 | 3.347 | 4.9272 | 0.1786 | 0.0145 | 0.4673 | 1.4605 | 5.0119 |
| After selecting face angle | 199.9985 | 1.9531 | 4.9272 | 4.1548 | 0.318 | 0.5688 | 1.1597 | 9.2568 |
| After selecting shaft angle | 310.9321 | 8.3312 | 11.6325 | 4.1548 | 0.0366 | 0.608 | 10.2873 | 2.6879 |
| After selecting lateral hit point | 858.3299 | 0.0022 | 33.3426 | 18.0003 | 58.9096 | 3.3061 | 10.2873 | 10.2174 |
| After selecting entering angle | 9224.858 | 0.2011 | 567.559 | 409.191 | 58.9096 | 0.3947 | 264.525 | 134.798 |

Since all the variance ratios of unselected variables are equal to or less than 2, selection is ended.

TABLE 3

| Standard partial regression coefficient (tester A) | | | | | | | | |
|---|---|---|---|---|---|---|---|---|
| | Standard partial regression coefficient | | | | | | | |
| Step | Constant term | H/S | Face angle | Shaft angle | Entering angle | Blow angle | Lateral hit point | Vertical hit point |
| After ending selection | — | — | 0.6 | 0.8 | 0.2 | — | −0.4 | −0.3 |

As shown in Table 3, when the absolute values of these standard partial regression coefficients were compared, the absolute value of the shaft angle was maximum. Therefore, the shaft angle can be considered to have a high degree of contribution to the hit ball arrival point data (carry). The shaft angle was employed as a specific explanation variable.

A recommended club A was determined based on the results. A flex (shaft hardness) was employed as a specification capable of suppressing the variation in the specific explanation variable (shaft angle). A club having a flex less than that of the reference club A was the recommended club A, based on the specification determination reference (9*a*).

The tester A hit a ball eight times using the recommended club A. The measuring results of these hits are shown in the following Table 4. When Table 1 (comparative example 1) was compared with Table 4 (example 1), the standard deviation of the shaft angle was decreased, and the standard deviation of the carry was decreased. That is, the stability of the carry was improved.

TABLE 4

| Results in recommended club (tester A) | | | | | | | | | |
|---|---|---|---|---|---|---|---|---|---|
| Tester | Flex | H/S | Face angle | Shaft angle | Entering angle | Blow angle | Lateral hit point | Vertical hit point | Carry |
| A | Small flex | 43.9 | 5.4 | −2.4 | 1.3 | 0.3 | 4.4 | 1.6 | 216 |
| A | Small flex | 43.3 | 6.2 | −3.0 | 2.6 | 0.7 | 11.6 | 9.3 | 190 |
| A | Small flex | 43.7 | 4.4 | −2.8 | 1.5 | 0.5 | 8.8 | −2.0 | 207 |
| A | Small flex | 42.9 | 5.3 | −2.7 | 3.2 | 1.5 | 14.2 | −4.3 | 204 |
| A | Small flex | 43.5 | 4.0 | −2.0 | 2.6 | 1.9 | 0.1 | 8.2 | 197 |
| A | Small flex | 43.7 | 5.0 | −3.3 | 1.8 | 0.1 | 5.6 | 6.2 | 192 |
| A | Small flex | 43.2 | 6.2 | −3.3 | 2.6 | 0.2 | 10.1 | −1.4 | 207 |
| A | Small flex | 43.3 | 5.5 | −1.5 | 1.7 | 1.1 | 14.7 | −5.3 | 211 |
| | | | | σ = 0.6 | | | | σ = 9.2 | |

Example 2 and Comparative Example 2

A reference club B was prepared. The reference club B was a driver. A tester B hit a ball seven times. In these hits, an impact condition and hit ball arrival point data were measured. As the impact condition, a head speed, a face angle, a shaft angle, an entering angle, a blow angle, a lateral hit point, and a vertical hit point were measured. Lateral deviation was measured as the hit ball arrival point data. These measuring results are shown in the following Table 5.

TABLE 5

| Measurement data of tester B using reference club | | | | | | | | | |
|---|---|---|---|---|---|---|---|---|---|
| Tester | Flex | H/S m/s | Face angle degree | Shaft angle degree | Entering angle degree | Blow angle degree | Lateral hit point mm | Vertical hit point mm | Lateral deviation yard |
| B | Reference | 44.2 | 6.3 | 1.4 | 1.1 | 2.9 | −2.5 | −8.1 | −17 |
| B | Reference | 43.7 | 6.1 | 0.2 | −0.5 | 0.7 | 17.6 | −2.0 | −14 |
| B | Reference | 44.4 | 4.8 | 0.2 | 0.3 | 2.1 | 4.8 | 1.6 | −14 |
| B | Reference | 43.7 | 8.8 | −0.5 | 0.7 | 0.8 | 12.4 | −2.3 | 14 |
| B | Reference | 43.1 | 5.3 | −0.2 | 0.8 | 1.4 | 18.9 | 3.4 | −9 |
| B | Reference | 43.9 | 10.5 | −1.6 | 2.0 | 0.8 | 17.8 | 1.2 | 31 |
| B | Reference | 43.6 | 11.2 | −2.5 | 1.8 | 0.6 | 23.1 | 10.7 | 43 |
| | | | | σ = 2.6 | | | | σ = 24.5 | |

Since the data of Table 5 are hit ball results before fitting, the data are considered to be comparative example (comparative example 2).

These measurement data were input into an information processor 12 (computer). A forward selection method was employed as a variable selection method. The software conducted the forward selection method in the same manner as in example 1 using the measurement data. A variance ratio calculated in each step is shown in the following Table 6.

TABLE 6

Variance ratio (tester B)

| Step | Variance ratio | | | | | | | |
|---|---|---|---|---|---|---|---|---|
| | Constant term | H/S | Face angle | Shaft angle | Entering angle | Blow angle | Lateral hit point | Vertical hit point |
| In the case of selecting only constant term | 0.275 | 0.2815 | 66.1759 | 37.992 | 6.8325 | 3.8474 | 3.2157 | 3.689 |
| After selecting face angle | 52.0633 | 0.4752 | 66.1759 | 24.191 | 0.2048 | 0.527 | 1.8143 | 19.639 |
| After selecting shaft angle | 47.2368 | 0.18 | 42.6707 | 24.191 | 2.2909 | 2.724 | 3.6654 | 0.2202 |
| After selecting lateral hit point | 25.0928 | 9.8948 | 43.0336 | 29.317 | 0.6526 | 0.1052 | 3.6654 | 0.0003 |
| After selecting H/S | 7.8555 | 9.8948 | 152.631 | 119.32 | 0.0527 | 1.3826 | 22.932 | 8.7091 |
| After selecting vertical hit point | 46.8379 | 56.7359 | 96.3843 | 143.25 | −1.11E+10 | −1.16E+10 | 112.067 | 8.7091 |

Since all the variance ratios of unselected variables are equal to or less than 2, selection is ended.

As shown in Table 6, the selected explanation variables were the face angle, the shaft angle, the lateral hit point, the head speed, and the vertical hit point in the order of steps. Other explanation variables were not selected because all the variance ratios were equal to or less than a boundary variance ratio. That is, the entering angle and the blow angle were not selected. Next, multiple linear regression analysis was conducted therefor, and a standard partial regression coefficient was calculated for each of the explanation variables selected by the variable selection method. The results are shown in the following Table 7.

TABLE 7

Standard partial regression coefficient (tester B)

| Step | Standard partial regression coefficient | | | | | | | |
|---|---|---|---|---|---|---|---|---|
| | Constant term | H/S | Face angle | Shaft angle | Entering angle | Blow angle | Lateral hit point | Vertical hit point |
| After ending selection | — | −0.1 | 0.4 | −0.9 | — | — | −0.3 | −0.1 |

As shown in Table 7, when the absolute values of these standard partial regression coefficients were compared, the absolute value of the shaft angle was maximum. Therefore, the shaft angle can be considered to have a high degree of contribution to the hit ball arrival point data (lateral deviation). The shaft angle was employed as a specific explanation variable.

A recommended club B was determined based on the results. A flex (shaft hardness) was employed as a specification capable of suppressing the variation in the specific explanation variable (shaft angle). A club having a flex less than that of the reference club B was the recommended club B, based on the specification determination reference (9*a*).

The tester B hit a ball seven times using the recommended club B. The measuring results of these hits are shown in the following Table 8. When Table 5 (comparative example 2) was compared with Table 8 (example 2), the standard deviation of the shaft angle was decreased, and the standard deviation of the lateral deviation was also decreased. That is, the stability of the lateral deviation was improved. In other words, the directional stability of a hit ball was improved.

TABLE 8

| Results in recommended club (tester B) | | | | | | | | | |
|---|---|---|---|---|---|---|---|---|---|
| Tester | Flex | H/S | Face angle | Shaft angle | Entering angle | Blow angle | Lateral hit point | Vertical hit point | Lateral deviation |
| B | Small flex | 44.3 | 6.7 | 1.1 | −0.6 | 1.4 | 13.3 | 2.9 | 8 |
| B | Small flex | 44.5 | 7.7 | 0.0 | 0.1 | 1.3 | 15.3 | −2.2 | 10 |
| B | Small flex | 43.5 | 5.9 | 1.6 | 0.1 | 2.9 | 18.4 | −0.1 | −20 |
| B | Small flex | 43.9 | 8.4 | 0.9 | 1.1 | 2.1 | 15.8 | −2.8 | 5 |
| B | Small flex | 44.2 | 8.6 | 0.0 | 1.3 | 1.9 | 12.3 | 2.9 | 16 |
| B | Small flex | 44.2 | 7.7 | 1.6 | 1.1 | 1.3 | 12.8 | 5.8 | 12 |
| B | Small flex | 43.9 | 9.5 | 1.1 | 0.4 | 2.1 | 19.6 | 6.2 | 19 |
| | | | σ = 1.2 | | | | | σ = 12.9 | |

Example 3 and Comparative Example 3

A reference club C was prepared. The reference club C was a driver. A tester C hit a ball five times. In these hits, an impact condition and hit ball arrival point data were measured. As the impact condition, a head speed, a face angle, a shaft angle, an entering angle, a blow angle, a lateral hit point, and a vertical hit point were measured. Lateral deviation was measured as the hit ball arrival point data. These measuring results are shown in the following Table 9.

TABLE 9

| Measurement data of tester C using reference club | | | | | | | | | |
|---|---|---|---|---|---|---|---|---|---|
| Tester | Flex point | H/S m/s | Face angle degree | Shaft angle degree | Entering angle degree | Blow angle degree | Lateral hit point mm | Vertical hit point mm | Lateral deviation yard |
| C | Reference | 45.2 | 2.6 | 0.2 | −0.2 | 2.4 | 6.1 | −8.7 | −27 |
| C | Reference | 45.5 | 5.7 | 0.0 | 0.6 | 1.7 | 10.4 | −6.7 | 10 |
| C | Reference | 46.1 | 4.2 | 1.4 | −1.2 | 2.4 | −4.4 | −0.2 | 9 |
| C | Reference | 45.8 | 4.0 | 1.4 | −0.2 | 3.4 | −4.7 | −5.1 | −2 |
| C | Reference | 45.8 | 5.5 | 0.7 | 0.2 | 2.7 | −5.7 | −11.1 | 16 |
| | | | σ = 1.2 | | | | | σ = 17.0 | |

Since the data of Table 9 are hit ball results before fitting, the data are considered to be comparative example (comparative example 3).

These measurement data were input into an information processor 12 (computer). A forward selection method was employed as a variable selection method. The software conducted the forward selection method in the same manner as in example 1 using the measurement data. A variance ratio calculated in each step is shown in the following Table 10.

TABLE 10

| Variance ratio (tester C) | | | | | | | | |
|---|---|---|---|---|---|---|---|---|
| | Variance ratio | | | | | | | |
| Step | Constant term | H/S | Face angle | Shaft angle | Entering angle | Blow angle | Lateral hit point | Vertical hit point |
| In the case of selecting only constant term | 0.0248 | 3.0925 | 14.596 | 0.2002 | 0.0388 | 0.042 | 0.4615 | 0.0528 |

TABLE 10-continued

| Variance ratio (tester C) | | | | | | | | |
|---|---|---|---|---|---|---|---|---|
| | Variance ratio | | | | | | | |
| Step | Constant term | H/S | Face angle | Shaft angle | Entering angle | Blow angle | Lateral hit point | Vertical hit point |
| After selecting face angle | 13.1 | 76.04 | 14.596 | 8.6644 | 19.497 | 0.472 | 4.3308 | 1.587 |
| After selecting H/S | 84.378 | 76.04 | 223.39 | 1.7388 | 0.7507 | 0.322 | 0.0107 | 0.108 |

Since all the variance ratios of unselected variables are equal to or less than 2, selection is ended.

As shown in Table 10, the selected explanation variables were the face angle and the head speed in the order of steps. Other explanation variables were not selected because all the variance ratios were equal to or less than a boundary variance ratio. That is, the shaft angle, the entering angle, the blow angle, the lateral hit point, and the vertical hit point were not selected. Next, multiple linear regression analysis was conducted therefor, and a standard partial regression coefficient was calculated for each of the explanation variables selected by the variable selection method. The results are shown in the following Table 11.

TABLE 11

| Standard partial regression coefficient (tester C) | | | | | | | | |
|---|---|---|---|---|---|---|---|---|
| | Standard partial regression coefficient | | | | | | | |
| Step | Constant term | H/S | Face angle | Shaft angle | Entering angle | Blow angle | Lateral hit point | Vertical hit point |
| After ending selection | — | 0.4 | 0.8 | — | — | — | — | — |

As shown in Table 11, when the absolute values of these standard partial regression coefficients were compared, the absolute value of the face angle was maximum. Therefore, the face angle can be considered to have a high degree of contribution to the hit ball arrival point data (lateral deviation). The face angle was employed as a specific explanation variable.

A recommended club C was determined based on the results. A low flex point rate was employed as a specification capable of suppressing the variation in the specific explanation variable (face angle). A club having a low flex point rate less than that of the reference club C was the recommended club C, based on the specification determination reference (2*b*).

The tester C hit a ball five times using the recommended club C. The measuring results of these hits are shown in the following Table 12. When Table 9 (comparative example 3) was compared with Table 12 (example 3), the standard deviation of the face angle was decreased, and the standard deviation of the lateral deviation was also decreased. That is, the stability of the lateral deviation was improved. In other words, the directional stability of a hit ball was improved.

TABLE 12

| Results in recommended club (tester C) | | | | | | | | | |
|---|---|---|---|---|---|---|---|---|---|
| Tester | Flex point | H/S | Face angle | Shaft angle | Entering angle | Blow angle | Lateral hit point | Vertical hit point | Lateral deviation |
| C | Small low flex point rate | 44.9 | 5.0 | 0.5 | 0.3 | 3.2 | 2.8 | −6.7 | 14 |
| C | Small low flex point rate | 45.2 | 6.6 | 0.9 | 0.3 | 2.6 | 4.4 | −8.9 | 18 |
| C | Small low flex point rate | 46.1 | 4.6 | 1.4 | −0.9 | 3.1 | −12.1 | −3.8 | 13 |
| C | Small low flex point rate | 45.8 | 4.4 | 0.0 | −0.2 | 1.9 | −1.9 | −11.5 | 11 |

TABLE 12-continued

| Results in recommended club (tester C) | | | | | | | | | |
|---|---|---|---|---|---|---|---|---|---|
| Tester | Flex point | H/S | Face angle | Shaft angle | Entering angle | Blow angle | Lateral hit point | Vertical hit point | Lateral deviation |
| C | Small low flex point rate | 45.2 | 5.3 | 1.6 | −0.5 | 3.1 | 2.8 | 1.7 | 20 |
| | | σ = 0.9 | | | | | | σ = 3.7 | |

Particularly, ordinary golf players have large variation in a swing and large variation in a hit ball. If the variation in a flight distance is large even when an average flight distance is large, a good score is hardly obtained. If the variation in the lateral deviation is large, the directivity of the hit ball is not stabilized. Furthermore, the variation in the lateral deviation may lead also to reduction in the flight distance. If the variation in the lateral deviation is large, a good score is hardly obtained. The fitting method shown in the embodiment can effectively suppress the variation in the hit ball arrival point. Therefore, effective fitting for obtaining a good score can be attained.

[Test According to Second Aspect of the Present Invention]

A hit ball result database was created for each head speed. The hit ball result database was created for each of the head speeds of 40 m/s, 45 m/s, and 50 m/s. In this example, the hit ball result was a total flight distance. That is, the hit ball result database was a flight distance database. The flight distance database is a flight distance prediction map shown in FIGS. 12, 16, and 20. All the flight distance prediction maps show a contour line. The club numbers of the reference club and recommended club were drivers.

Figure 9:
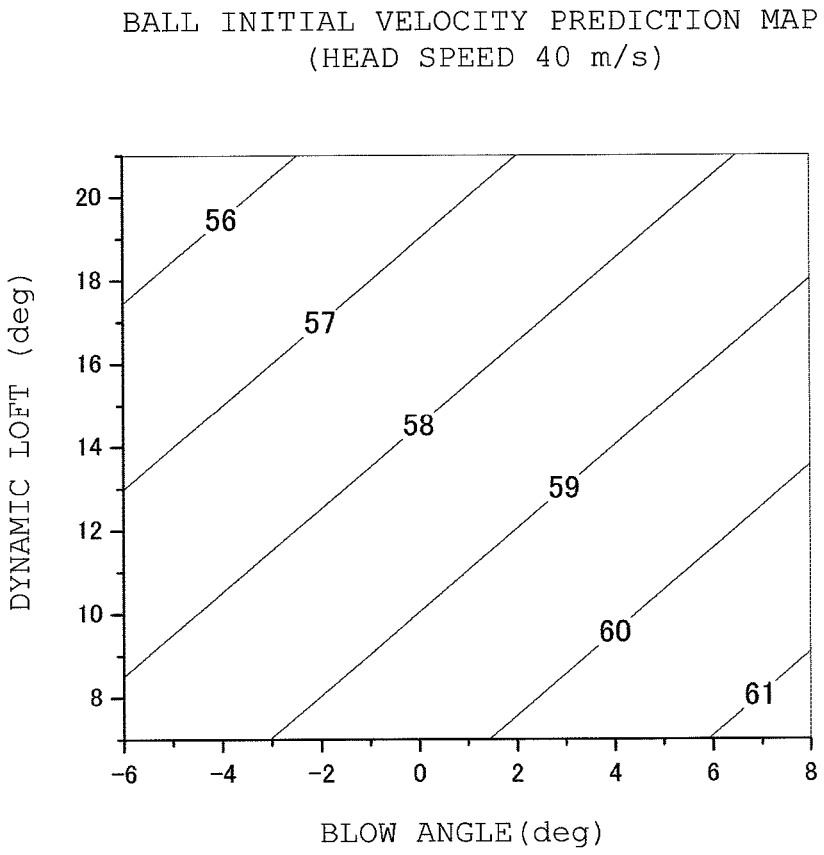
FIG. 9 shows a ball initial velocity prediction map when a head speed is 40 m/s.
Figure 10:
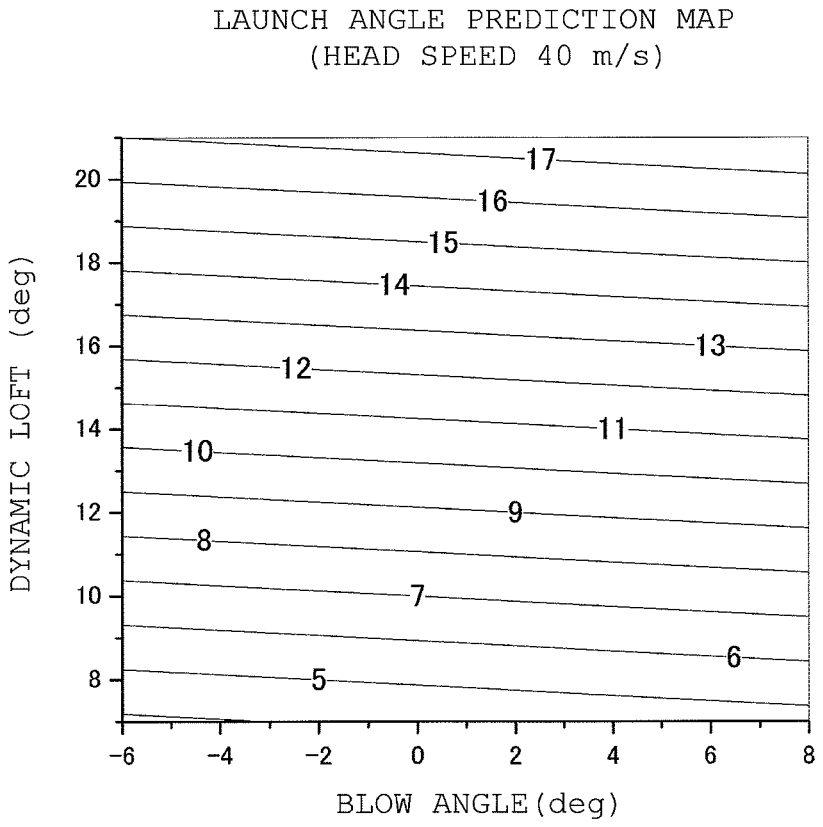
FIG. 10 shows a launch angle prediction map when the head speed is 40 m/s.
Figure 11:
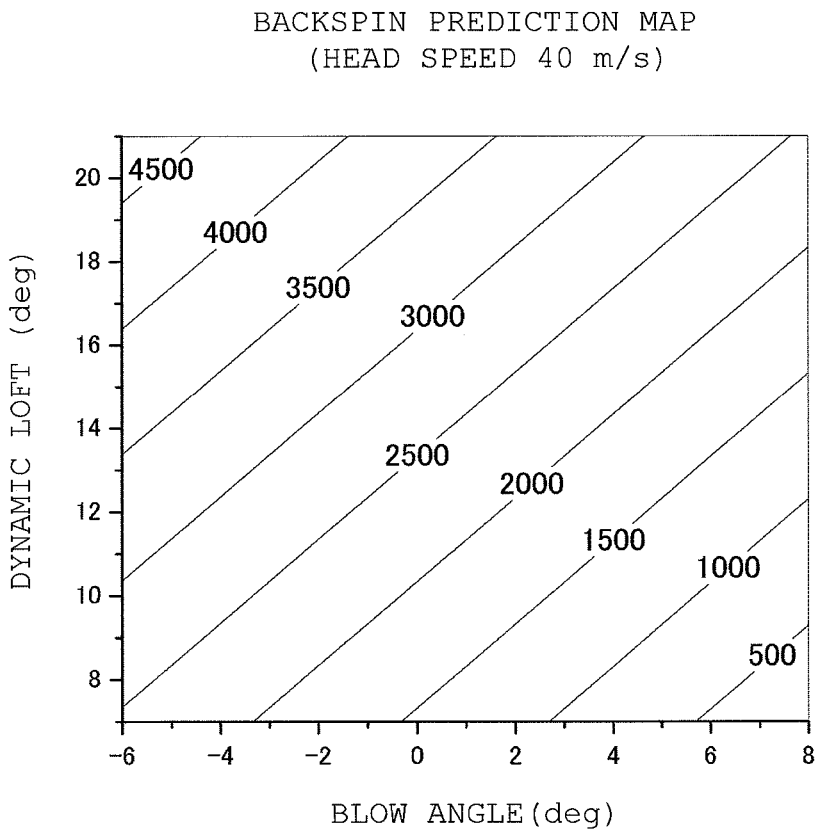
FIG. 11 shows a backspin prediction map when the head speed is 40 m/s.
Figure 12:
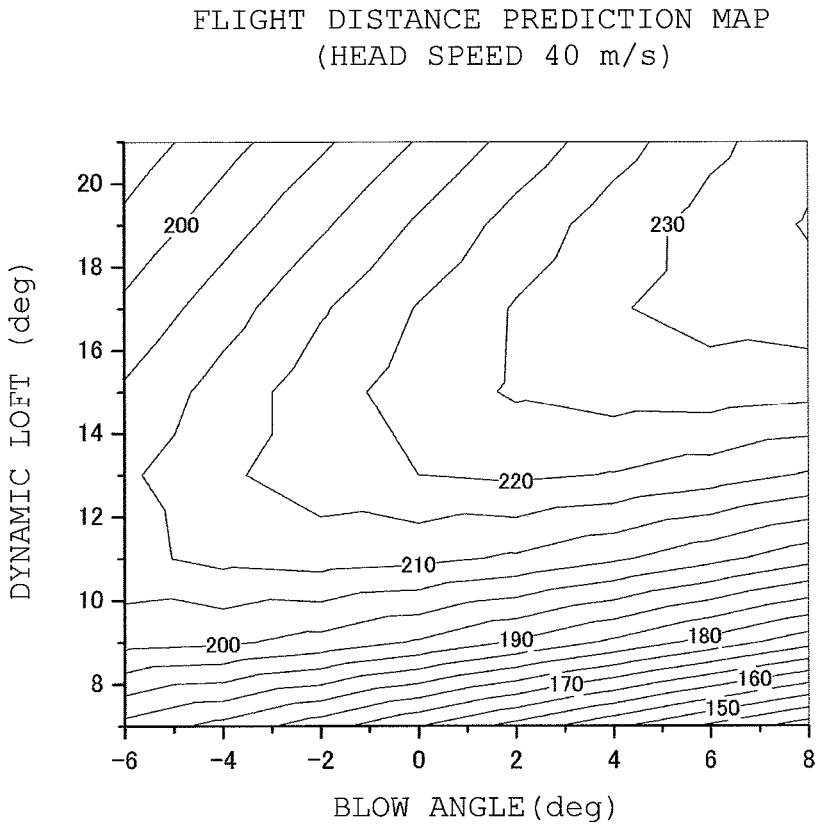
FIG. 12 shows a flight distance prediction map when the head speed is 40 m/s.
Figure 13:
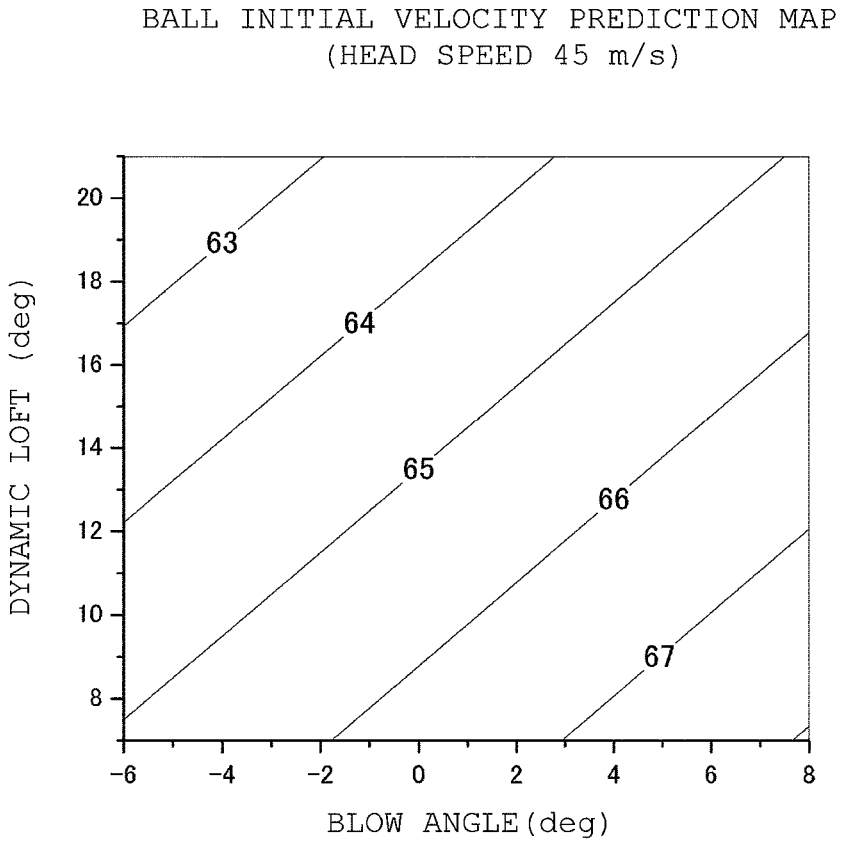
FIG. 13 shows a ball initial velocity prediction map when the head speed is 45 m/s.
Figure 14:
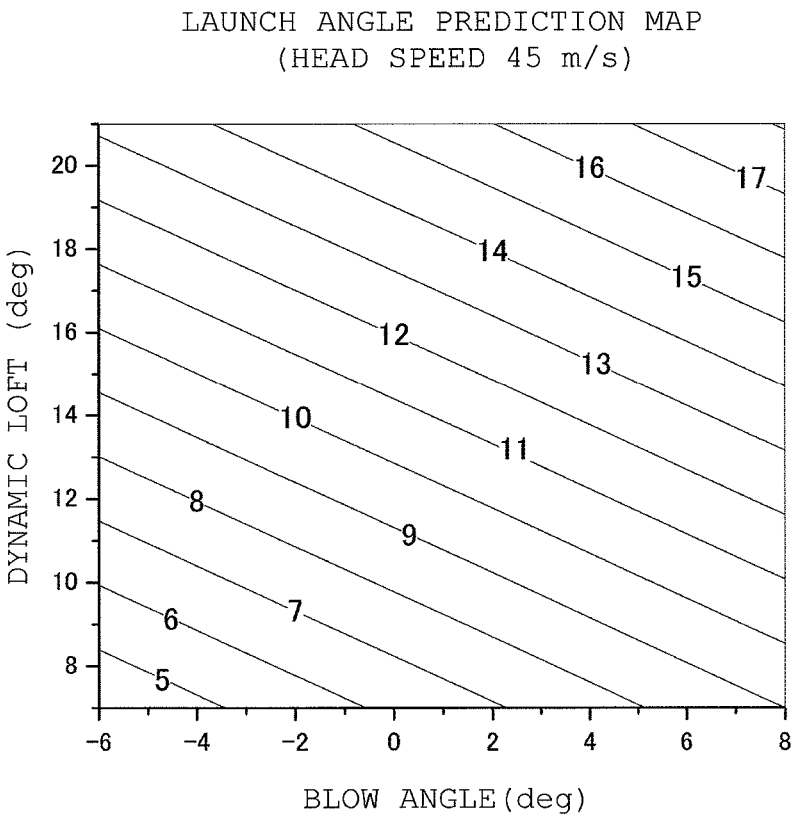
FIG. 14 shows a launch angle prediction map when the head speed is 45 m/s.
Figure 15:
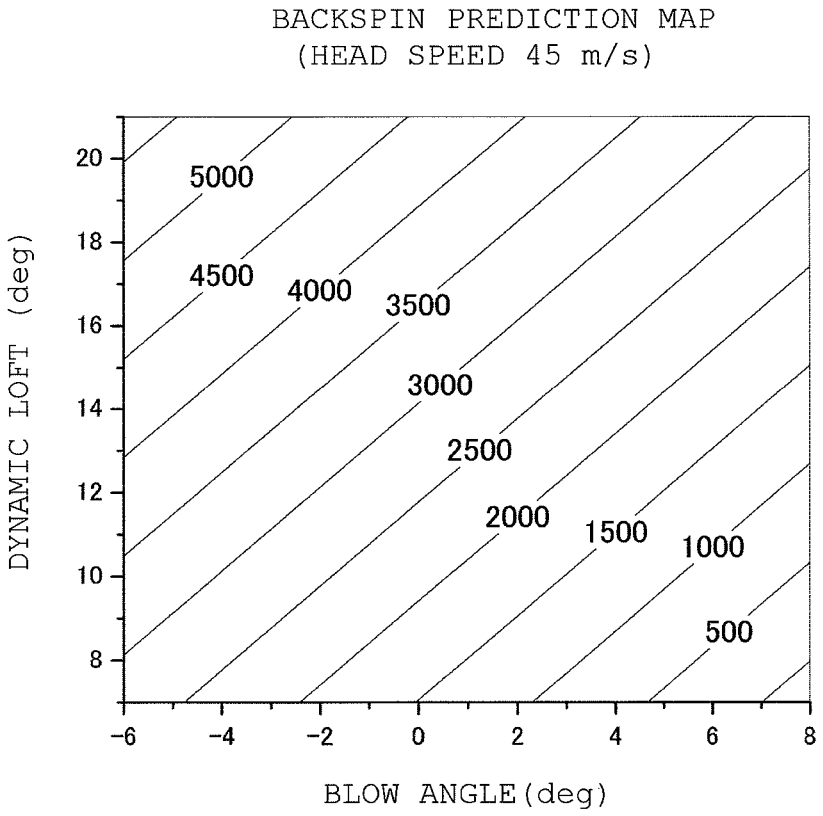
FIG. 15 shows a backspin prediction map when the head speed is 45 m/s.
Figure 16:
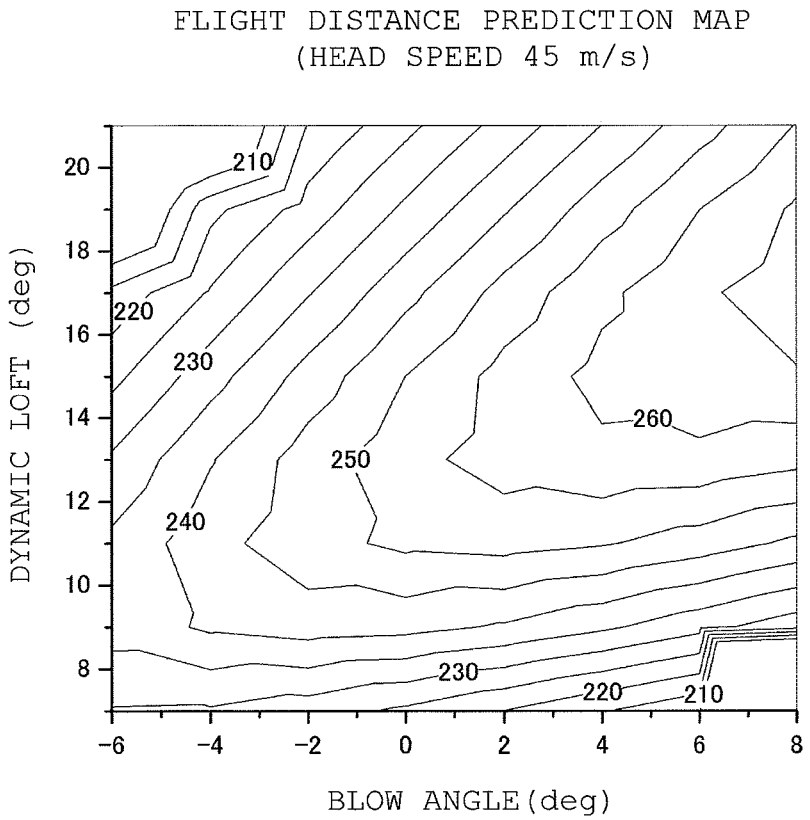
FIG. 16 shows a flight distance prediction map when the head speed is 45 m/s.
Figure 17:
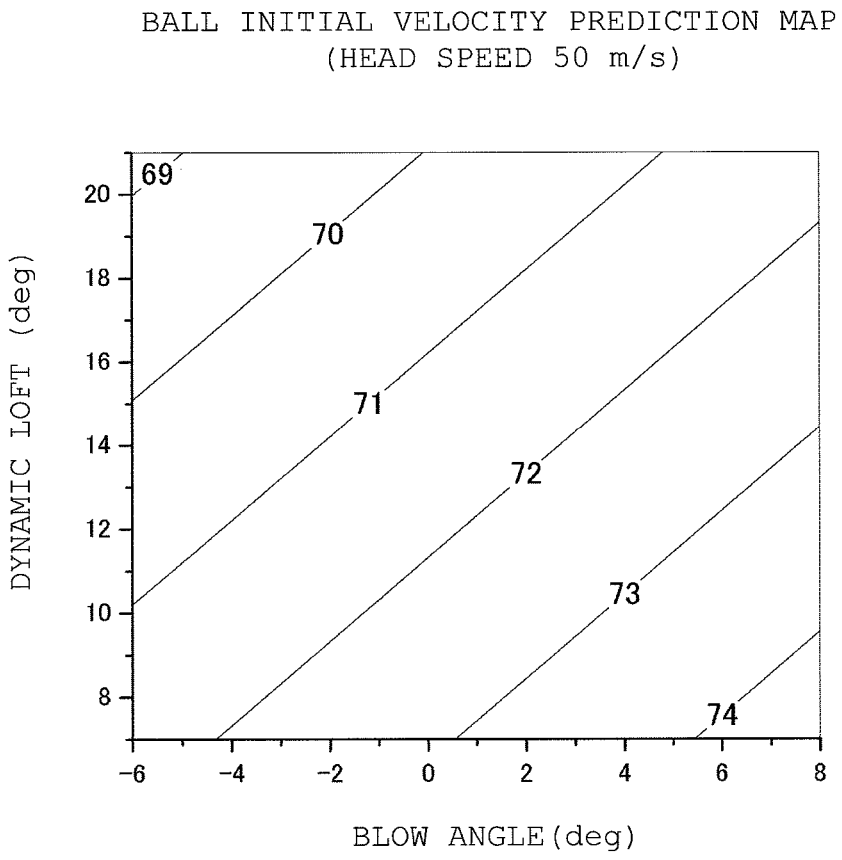
FIG. 17 shows a ball initial velocity prediction map when the head speed is 50 m/s.
Figure 18:
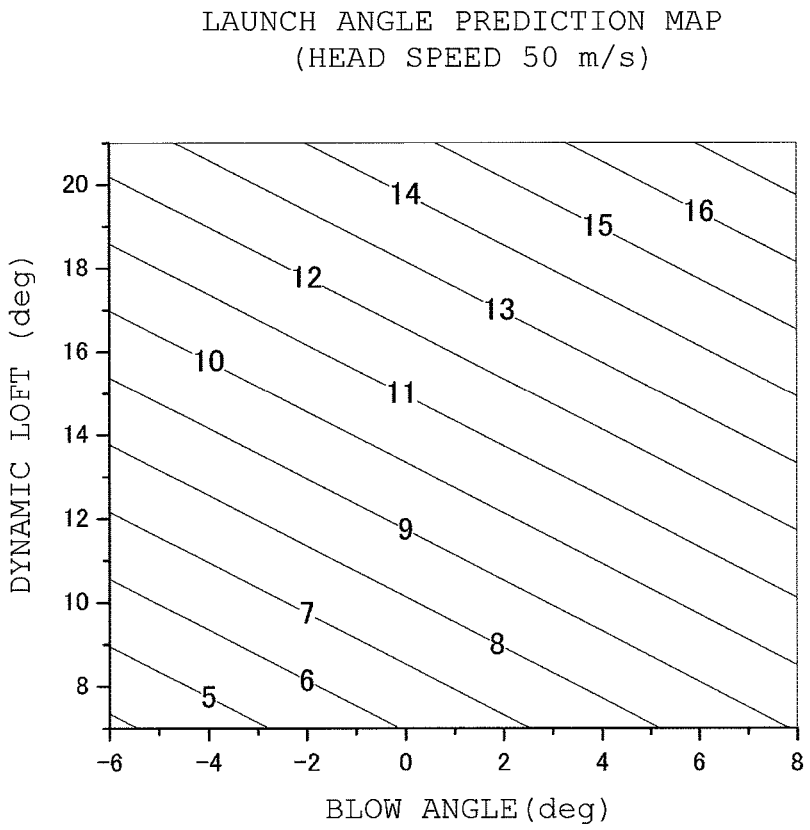
FIG. 18 shows a launch angle prediction map when the head speed is 50 m/s.
Figure 19:
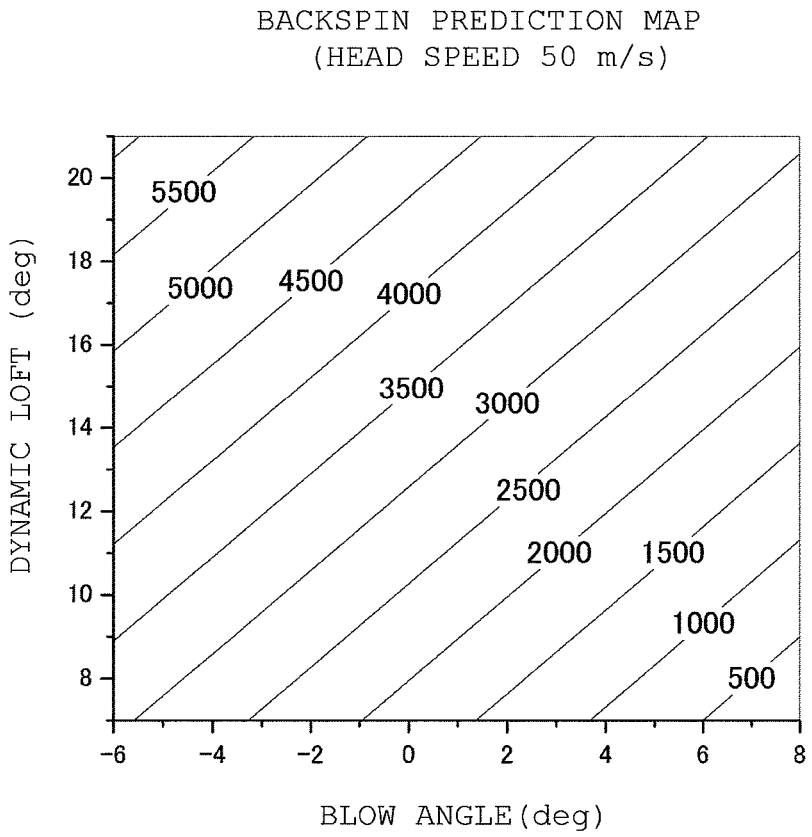
FIG. 19 shows a backspin prediction map when the head speed is 50 m/s.
Figure 20:
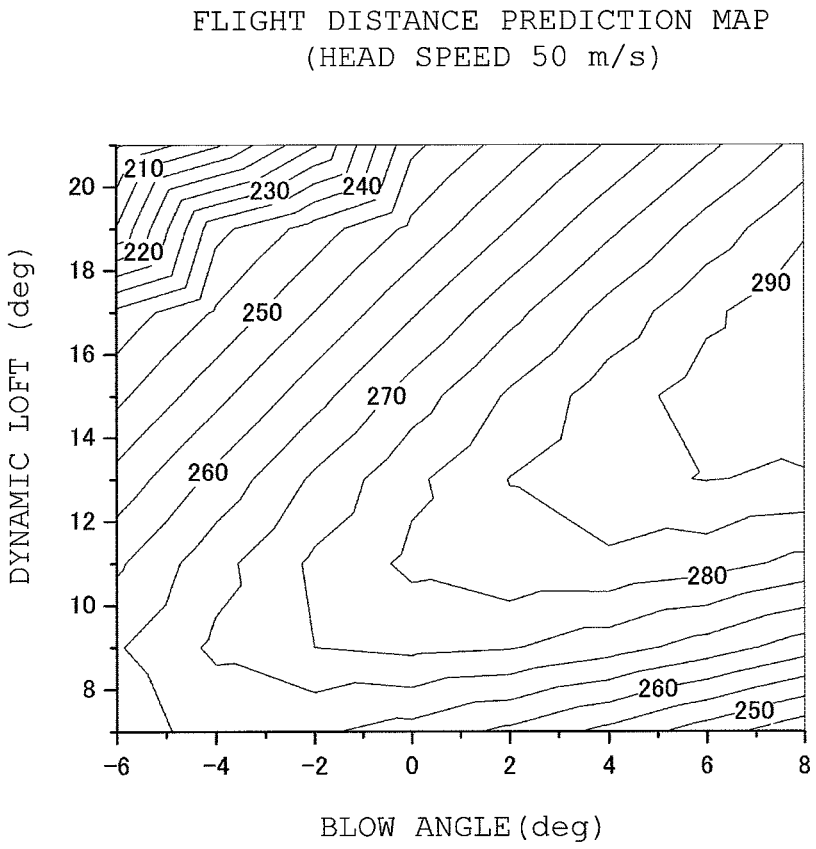
FIG. 20 shows a flight distance prediction map when the head speed is 50 m/s.

FIG. 9 shows a ball initial velocity prediction map when the head speed is 40 m/s. FIG. 10 shows a launch angle prediction map when the head speed is 40 m/s. FIG. 11 shows a backspin prediction map when the head speed is 40 m/s. FIG. 12 shows a flight distance prediction map when the head speed is 40 m/s. FIG. 13 shows a ball initial velocity prediction map when the head speed is 45 m/s. FIG. 14 shows a launch angle prediction map when the head speed is 45 m/s. FIG. 15 shows a backspin prediction map when the head speed is 45 m/s. FIG. 16 shows a flight distance prediction map when the head speed is 45 m/s. FIG. 17 shows a ball initial velocity prediction map when the head speed is 50 m/s. FIG. 18 shows a launch angle prediction map when the head speed is 50 m/s. FIG. 19 shows a backspin prediction map when the head speed is 50 m/s. FIG. 20 shows a flight distance prediction map when the head speed is 50 m/s.

The flight distance prediction map (FIG. 12) when the head speed was 40 m/s was obtained by using the ball initial velocity prediction map (FIG. 9), the launch angle prediction map (FIG. 10), and the backspin prediction map (FIG. 11).

The flight distance prediction map (FIG. 16) when the head speed was 45 m/s was obtained by using the ball initial velocity prediction map (FIG. 13), the launch angle prediction map (FIG. 14), and the backspin prediction map (FIG. 15).

The flight distance prediction map (FIG. 20) when the head speed was 50 m/s was obtained by using the ball initial velocity prediction map (FIG. 17), the launch angle prediction map (FIG. 18), and the backspin prediction map (FIG. 19).

The maps (contour line maps) of FIG. 9 to FIG. 12 were created as follows. The head speed was set to 40 m/s, and the blow angle was set to 0 degree. Balls were hit by a plurality of clubs having different loft angles to obtain data of a dynamic loft and hit ball initial conditions (ball initial velocity, a launch angle, a backspin). A change rate of the hit ball initial condition to the change in the dynamic loft was calculated by using the obtained data. Each launch condition for each dynamic loft when the blow angle was 0 degree was obtained based on the change rate, one reference dynamic loft, and the hit ball initial condition in the dynamic loft.

In the case where the blow angle was other than 0 degree, the change rate when the blow angle was 0 degree was utilized. If the dynamic loft or the like is considered to be changed by the blow angle in the case of the blow angle other than 0 degree, data when the blow angle is 0 degree can be utilized. Values of each blow angle and each launch condition for each dynamic loft were obtained by using the change rate based on the method of thinking.

Calculation results when the head speed is 40 (m/s) are shown in the following Tables 13 to 15. The ball initial velocity prediction map (FIG. 9), the launch angle prediction map (FIG. 10), and the backspin prediction map (FIG. 11) were created based on the results shown in these Tables. Furthermore, the hit ball initial condition for each blow angle and each dynamic loft was obtained based on the data of Tables 13 to 15. Data of Table 16 and the flight distance prediction map (FIG. 12) were obtained by using a trajectory simulation (trajectory equation) based on the hit ball initial condition.

Calculation results when the head speed is 45 (m/s) are shown in the following Tables 17 to 19. The ball initial velocity prediction map (FIG. 13), the launch angle prediction map (FIG. 14), and the backspin prediction map (FIG. 15) were created based on the results shown in these Tables. Furthermore, the hit ball initial condition for each blow angle and each dynamic loft was obtained based on the data of Tables 17 to 19. Data of Table 20 and the flight distance prediction map (FIG. 16) were obtained by using the trajectory simulation (trajectory equation) based on the hit ball initial condition. The maps of FIGS. 13 to 16 are contour line maps.

Calculation results when the head speed is 50 (m/s) are shown in the following Tables 21 to 23. The ball initial velocity prediction map (FIG. 17), the launch angle prediction map (FIG. 18), and the backspin prediction map (FIG. 19) were created based on the results shown in these Tables. Furthermore, the hit ball initial condition for each blow angle and each dynamic loft was obtained based on the data of Tables 21 to 23. Data of Table 24 and the flight distance prediction map (FIG. 20) were obtained by using the trajectory simulation (trajectory equation) based on the hit ball initial condition. The maps of FIGS. 17 to 20 are contour line maps.

TABLE 13

Ball initial velocity (m/s) when head speed is 40 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 58.34 | 58.78 | 59.23 | 59.68 | 60.13 | 60.57 | 61.02 | 61.47 |
| | 9.0 | 57.89 | 58.34 | 58.78 | 59.23 | 59.68 | 60.13 | 60.57 | 61.02 |
| | 11.0 | 57.44 | 57.89 | 58.34 | 58.78 | 59.23 | 59.68 | 60.13 | 60.57 |
| | 13.0 | 56.99 | 57.44 | 57.89 | 58.34 | 58.78 | 59.23 | 59.68 | 60.13 |
| | 15.0 | 56.55 | 56.99 | 57.44 | 57.89 | 58.34 | 58.78 | 59.23 | 59.68 |
| | 17.0 | 56.10 | 56.55 | 56.99 | 57.44 | 57.89 | 58.34 | 58.78 | 59.23 |
| | 19.0 | 55.65 | 56.10 | 56.55 | 56.99 | 57.44 | 57.89 | 58.34 | 58.78 |
| | 21.0 | 55.21 | 55.65 | 56.10 | 56.55 | 56.99 | 57.44 | 57.89 | 58.34 |

TABLE 14

Launch angle (degree) when head speed is 40 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 3.8 | 3.9 | 4.1 | 4.2 | 4.3 | 4.4 | 4.5 | 4.7 |
| | 9.0 | 5.7 | 5.8 | 5.9 | 6.1 | 6.2 | 6.3 | 6.4 | 6.5 |
| | 11.0 | 7.6 | 7.7 | 7.8 | 7.9 | 8.1 | 8.2 | 8.3 | 8.4 |
| | 13.0 | 9.5 | 9.6 | 9.7 | 9.8 | 9.9 | 10.1 | 10.2 | 10.3 |
| | 15.0 | 11.4 | 11.5 | 11.6 | 11.7 | 11.8 | 11.9 | 12.1 | 12.2 |
| | 17.0 | 13.2 | 13.4 | 13.5 | 13.6 | 13.7 | 13.8 | 13.9 | 14.1 |
| | 19.0 | 15.1 | 15.2 | 15.4 | 15.5 | 15.6 | 15.7 | 15.8 | 15.9 |
| | 21.0 | 17.0 | 17.1 | 17.2 | 17.4 | 17.5 | 17.6 | 17.7 | 17.8 |

TABLE 15

Backspin (rpm) when head speed is 40 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 2443 | 2111 | 1779 | 1447 | 1116 | 784 | 452 | 120 |
| | 9.0 | 2775 | 2443 | 2111 | 1779 | 1447 | 1116 | 784 | 452 |
| | 11.0 | 3107 | 2775 | 2443 | 2111 | 1779 | 1447 | 1116 | 784 |
| | 13.0 | 3439 | 3107 | 2775 | 2443 | 2111 | 1779 | 1447 | 1116 |
| | 15.0 | 3771 | 3439 | 3107 | 2775 | 2443 | 2111 | 1779 | 1447 |
| | 17.0 | 4103 | 3771 | 3439 | 3107 | 2775 | 2443 | 2111 | 1779 |
| | 19.0 | 4435 | 4103 | 3771 | 3439 | 3107 | 2775 | 2443 | 2111 |
| | 21.0 | 4766 | 4435 | 4103 | 3771 | 3439 | 3107 | 2775 | 2443 |

TABLE 16

Flight distance (yard) when head speed is 40 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 183.3 | 178.3 | 172.2 | 165.3 | 158.3 | 151.2 | 144.2 | 137.5 |
| | 9.0 | 201.7 | 200.8 | 198.3 | 194.5 | 189.5 | 184.1 | 178.2 | 172.1 |
| | 11.0 | 208.8 | 211.3 | 212.2 | 211.4 | 209.3 | 205.9 | 201.7 | 196.9 |
| | 13.0 | 209.1 | 214.1 | 217.8 | 220 | 221 | 219.8 | 217.7 | 214.6 |
| | 15.0 | 205.7 | 212.1 | 217.8 | 222.4 | 225.6 | 227.3 | 227.6 | 226.6 |
| | 17.0 | 201 | 207.7 | 214.4 | 220.3 | 225.4 | 229.5 | 232.1 | 233.3 |
| | 19.0 | 196.2 | 202.7 | 209.2 | 215.7 | 221.9 | 227.4 | 232 | 235.4 |
| | 21.0 | 191.7 | 198 | 204 | 210.3 | 216.7 | 222.8 | 228.6 | 233.5 |

TABLE 17

Ball initial velocity (m/s) when head speed is 45 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 65.10 | 65.53 | 65.95 | 66.38 | 66.80 | 67.22 | 67.65 | 68.07 |
| | 9.0 | 64.68 | 65.10 | 65.53 | 65.95 | 66.38 | 66.80 | 67.22 | 67.65 |
| | 11.0 | 64.26 | 64.68 | 65.10 | 65.53 | 65.95 | 66.38 | 66.80 | 67.22 |
| | 13.0 | 63.83 | 64.26 | 64.68 | 65.10 | 65.53 | 65.95 | 66.38 | 66.80 |
| | 15.0 | 63.41 | 63.83 | 64.26 | 64.68 | 65.10 | 65.53 | 65.95 | 66.38 |
| | 17.0 | 62.98 | 63.41 | 63.83 | 64.26 | 64.68 | 65.10 | 65.53 | 65.95 |
| | 19.0 | 62.56 | 62.98 | 63.41 | 63.83 | 64.26 | 64.68 | 65.10 | 65.53 |
| | 21.0 | 62.14 | 62.56 | 62.98 | 63.41 | 63.83 | 64.26 | 64.68 | 65.10 |

TABLE 18

Launch angle (degree) when head speed is 45 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 4.1 | 4.8 | 5.5 | 6.2 | 6.9 | 7.6 | 8.3 | 9.0 |
| | 9.0 | 5.4 | 6.1 | 6.8 | 7.5 | 8.2 | 8.9 | 9.6 | 10.3 |
| | 11.0 | 6.7 | 7.4 | 8.1 | 8.8 | 9.5 | 10.2 | 10.9 | 11.6 |
| | 13.0 | 8.0 | 8.7 | 9.4 | 10.1 | 10.8 | 11.5 | 12.2 | 12.9 |
| | 15.0 | 9.3 | 10.0 | 10.7 | 11.4 | 12.1 | 12.8 | 13.5 | 14.2 |
| | 17.0 | 10.6 | 11.3 | 12.0 | 12.7 | 13.4 | 14.1 | 14.8 | 15.5 |
| | 19.0 | 11.9 | 12.6 | 13.3 | 14.0 | 14.7 | 15.4 | 16.1 | 16.8 |
| | 21.0 | 13.2 | 13.9 | 14.6 | 15.3 | 16.0 | 16.7 | 17.4 | 18.1 |

TABLE 19

Backspin (rpm) when head speed is 45 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 2762 | 2338 | 1914 | 1490 | 1066 | 642 | 218 | −207 |
| | 9.0 | 3186 | 2762 | 2338 | 1914 | 1490 | 1066 | 642 | 218 |
| | 11.0 | 3611 | 3186 | 2762 | 2338 | 1914 | 1490 | 1066 | 642 |
| | 13.0 | 4035 | 3611 | 3186 | 2762 | 2338 | 1914 | 1490 | 1066 |
| | 15.0 | 4459 | 4035 | 3611 | 3186 | 2762 | 2338 | 1914 | 1490 |
| | 17.0 | 4883 | 4459 | 4035 | 3611 | 3186 | 2762 | 2338 | 1914 |
| | 19.0 | 5307 | 4883 | 4459 | 4035 | 3611 | 3186 | 2762 | 2338 |
| | 21.0 | 5731 | 5307 | 4883 | 4459 | 4035 | 3611 | 3186 | 2762 |

TABLE 20

Flight distance (yard) when head speed is 45 m/s

| | | Blow angle (degree) | | | | | | | |
|---|---|---|---|---|---|---|---|---|---|
| | | −6 | −4 | −2 | 0 | 2 | 4 | 6 | 8 |
| Dy-namic loft (degree) | 7.0 | 229.6 | 229.4 | 227.3 | 224 | 219.9 | 215.4 | 210.8 | 109.7 |
| | 9.0 | 237.1 | 240.8 | 242.3 | 241.7 | 239.4 | 236 | 231.7 | 227.2 |
| | 11.0 | 236.1 | 243.2 | 248.3 | 251.1 | 251.9 | 250.5 | 247.8 | 244 |
| | 13.0 | 230.7 | 239.6 | 247.4 | 253.4 | 257.2 | 258.9 | 258.6 | 256.6 |
| | 15.0 | 223.6 | 232.9 | 241.9 | 250 | 256.7 | 261.5 | 264.1 | 264.6 |
| | 17.0 | 216.4 | 225.5 | 234.6 | 243.4 | 251.7 | 258.8 | 264.2 | 267.6 |
| | 19.0 | 197.7 | 218.4 | 227.1 | 235.9 | 244.4 | 252.6 | 259.9 | 265.7 |
| | 21.0 | 184.9 | 196.8 | 220.2 | 228.5 | 236.8 | 245 | 252.9 | 260.2 |

TABLE 21

| Ball initial velocity (m/s) when head speed is 50 m/s | | | | | | | | | |
|---|---|---|---|---|---|---|---|---|---|
| | | Blow angle (degree) | | | | | | | |
| | | −6 | −4 | −2 | 0 | 2 | 4 | 6 | 8 |
| Dynamic loft (degree) | 7.0 | 71.66 | 72.07 | 72.47 | 72.88 | 73.29 | 73.70 | 74.11 | 74.52 |
| | 9.0 | 71.25 | 71.66 | 72.07 | 72.47 | 72.88 | 73.29 | 73.70 | 74.11 |
| | 11.0 | 70.84 | 71.25 | 71.66 | 72.07 | 72.47 | 72.88 | 73.29 | 73.70 |
| | 13.0 | 70.43 | 70.84 | 71.25 | 71.66 | 72.07 | 72.47 | 72.88 | 73.29 |
| | 15.0 | 70.02 | 70.43 | 70.84 | 71.25 | 71.66 | 72.07 | 72.47 | 72.88 |
| | 17.0 | 69.61 | 70.02 | 70.43 | 70.84 | 71.25 | 71.66 | 72.07 | 72.47 |
| | 19.0 | 69.20 | 69.61 | 70.02 | 70.43 | 70.84 | 71.25 | 71.66 | 72.07 |
| | 21.0 | 68.79 | 69.20 | 69.61 | 70.02 | 70.43 | 70.84 | 71.25 | 71.66 |

TABLE 22

| Launch angle (degree) when head speed is 50 m/s | | | | | | | | | |
|---|---|---|---|---|---|---|---|---|---|
| | | Blow angle (degree) | | | | | | | |
| | | −6 | −4 | −2 | 0 | 2 | 4 | 6 | 8 |
| Dynamic loft (degree) | 7.0 | 3.8 | 4.5 | 5.3 | 6.0 | 6.8 | 7.6 | 8.3 | 9.1 |
| | 9.0 | 5.0 | 5.8 | 6.5 | 7.3 | 8.0 | 8.8 | 9.6 | 10.3 |
| | 11.0 | 6.3 | 7.0 | 7.8 | 8.5 | 9.3 | 10.0 | 10.8 | 11.6 |
| | 13.0 | 7.5 | 8.3 | 9.0 | 9.8 | 10.5 | 11.3 | 12.0 | 12.8 |
| | 15.0 | 8.8 | 9.5 | 10.3 | 11.0 | 11.8 | 12.5 | 13.3 | 14.0 |
| | 17.0 | 10.0 | 10.8 | 11.5 | 12.3 | 13.0 | 13.8 | 14.5 | 15.3 |
| | 19.0 | 11.3 | 12.0 | 12.8 | 13.5 | 14.3 | 15.0 | 15.8 | 16.5 |
| | 21.0 | 12.5 | 13.3 | 14.0 | 14.8 | 15.5 | 16.3 | 17.0 | 17.8 |

TABLE 23

| Backspin (rpm) when head speed is 50 m/s | | | | | | | | | |
|---|---|---|---|---|---|---|---|---|---|
| | | Blow angle (degree) | | | | | | | |
| | | −6 | −4 | −2 | 0 | 2 | 4 | 6 | 8 |
| Dynamic loft (degree) | 7.0 | 3091 | 2660 | 2228 | 1796 | 1364 | 932 | 501 | 69 |
| | 9.0 | 3523 | 3091 | 2660 | 2228 | 1796 | 1364 | 932 | 501 |
| | 11.0 | 3955 | 3523 | 3091 | 2660 | 2228 | 1796 | 1364 | 932 |
| | 13.0 | 4387 | 3955 | 3523 | 3091 | 2660 | 2228 | 1796 | 1364 |
| | 15.0 | 4819 | 4387 | 3955 | 3523 | 3091 | 2660 | 2228 | 1796 |
| | 17.0 | 5250 | 4819 | 4387 | 3955 | 3523 | 3091 | 2660 | 2228 |
| | 19.0 | 5682 | 5250 | 4819 | 4387 | 3955 | 3523 | 3091 | 2660 |
| | 21.0 | 6114 | 5682 | 5250 | 4819 | 4387 | 3955 | 3523 | 3091 |

TABLE 24

| Flight distance (yard) when head speed is 50 m/s | | | | | | | | | |
|---|---|---|---|---|---|---|---|---|---|
| | | Blow angle (degree) | | | | | | | |
| | | −6 | −4 | −2 | 0 | 2 | 4 | 6 | 8 |
| Dynamic loft (degree) | 7.0 | 263.6 | 266.1 | 265.7 | 263.1 | 258.9 | 253.6 | 247.5 | 241.3 |
| | 9.0 | 264.5 | 271 | 275 | 276.3 | 275.4 | 272.3 | 267.9 | 262.5 |
| | 11.0 | 259.2 | 268.3 | 276 | 281.1 | 283.8 | 284 | 282.3 | 278.6 |
| | 13.0 | 251.7 | 261.5 | 270.9 | 278.9 | 285.1 | 288.9 | 290.2 | 289.3 |
| | 15.0 | 243.8 | 253.5 | 263.1 | 272.4 | 280.7 | 287.6 | 292.3 | 294.6 |
| | 17.0 | 236.3 | 245.6 | 255 | 264.3 | 273.3 | 281.7 | 288.9 | 294.2 |
| | 19.0 | 210.3 | 238.3 | 247.2 | 256.1 | 265 | 273.8 | 281.9 | 289.2 |
| | 21.0 | 199.2 | 209.1 | 224.2 | 248.6 | 257.1 | 265.5 | 273.7 | 281.6 |

A tester TA, a tester TB, a tester TC, and a tester TD conduct evaluation. In the determination of a recommended loft angle, the flight distance prediction maps (FIGS. 12, 16, and 20) were used. The length of the recommended club was substantially equal to that of the reference club.

[Tester TA]

Measuring results in the reference club by the tester TA were as follows. A loft angle Ls of the reference club was 10.0 (degree).

Head Speed: 45.1 m/s
Dynamic loft: 11.0 (degree)
Blow Angle: 0.9 (degree)
Ball Initial Velocity: 64.8 m/s
Launch Angle: 9.7 (degree)
Backspin: 1674 (rpm)

In the test in the tester TA, a plurality of recommended club candidates were prepared. Loft variations of these recommended club candidates were 8.4 degrees, 10.0 degrees, and 11.2 degrees.

The flight distance prediction map nearest to the head speed of the tester TA was used based on the result. That is, the flight distance prediction map (FIG. 16) when the head speed was 45 m/s was used. It was confirmed that the increase of the dynamic loft can cause the increase of the flight distance when the blow angle was 0.9 degree based on the flight distance prediction map. That is, it was confirmed that a dynamic loft difference is a positive value. A recommended loft angle greater than the loft angle Ls of the reference club was selected from the loft variations based on the confirmation result. The selected recommended loft angle was 11.2 degrees. When measurement was performed by using the recommended club having the recommended loft angle, the results were as follows. The blow angle was almost the same as the measured value of the reference club.

Head Speed: 44.7 m/s
Dynamic loft: 11.9 (degree)
Blow Angle: 1.0 (degree)
Ball Initial Velocity: 64.2 m/s
Launch Angle: 10.9 (degree)
Backspin: 2154 (rpm)

[Tester TB]

Measuring results in the reference club by the tester TB were as follows. A loft angle Ls of the reference club was 10.0 (degree).

Head Speed: 45.1 m/s
Dynamic loft: 15.8 (degree)
Blow Angle: 1.1 (degree)
Ball Initial Velocity: 65.1 m/s
Launch Angle: 12.1 (degree)
Backspin: 3071 (rpm)

In the test in the tester TB, a plurality of recommended club candidates were prepared. Loft variations of these recommended club candidates were 8.4 degrees, 10.0 degrees, and 11.2 degrees.

The flight distance prediction map nearest to the head speed of the tester TB was used based on the result. That is, the flight distance prediction map when the head speed was 45 m/s was used. A recommended loft angle was selected in the same manner as in the case of the tester TA based on the flight distance prediction map. The selected recommended loft angle was 8.4 degrees. When measurement was performed by using the recommended club having the recommended loft angle, the results were as follows. The blow angle was almost the same as the measured value of the reference club.

Head Speed: 45.1 m/s
Dynamic loft: 12.9 (degree)
Blow Angle: 1.3 (degree)
Ball Initial Velocity: 65.5 m/s
Launch Angle: 10.6 (degree)
Backspin: 2875 (rpm)

[Tester TC]

Measuring results in the reference club by the tester TC were as follows. A loft angle Ls of the reference club was 10.0 (degree).

Head Speed: 46.8 m/s
Dynamic loft: 15.6 (degree)
Blow Angle: 1.8 (degree)
Ball Initial Velocity: 67.2 m/s
Launch Angle: 13.0 (degree)
Backspin: 3145 (rpm)

In the test in the tester TC, a plurality of recommended club candidates were prepared. Loft variations of these recommended club candidates were 8.4 degrees, 10.0 degrees, and 11.2 degrees.

The flight distance prediction map nearest to the head speed of the tester TC was used based on the result. That is, the flight distance prediction map when the head speed was 45 m/s was used. A recommended loft angle was selected in the same manner as in the case of the tester TA based on the flight distance prediction map. The selected recommended loft angle was 8.4 degrees. When measurement was performed by using the recommended club having the recommended loft angle, the results were as follows. The blow angle was almost the same as the measured value of the reference club.

Head Speed: 46.7 m/s
Dynamic loft: 13.1 (degree)
Blow Angle: 1.9 (degree)
Ball Initial Velocity: 67.4 m/s
Launch Angle: 11.6 (degree)
Backspin: 2686 (rpm)

[Tester TD]

Measuring results in the reference club by the tester TD were as follows. A loft angle Ls of the reference club was 10.0 (degree).

Head Speed: 44.6 m/s
Dynamic loft: 16.7 (degree)
Blow Angle: 3.0 (degree)
Ball Initial Velocity: 63.4 m/s
Launch Angle: 14.3 (degree)
Backspin: 2526 (rpm)

In the test in the tester TD, a plurality of recommended club candidates were prepared. Loft variations of these recommended club candidates were 8.4 degrees, 10.0 degrees, and 11.2 degrees.

The flight distance prediction map nearest to the head speed of the tester TD was used based on the result. That is, the flight distance prediction map when the head speed was 45 m/s was used. A recommended loft angle was selected in the same manner as in the case of the tester TA based on the flight distance prediction map. The selected recommended loft angle was 8.4 degrees. When measurement was performed by using the recommended club having the recommended loft angle, the results were as follows. The blow angle was almost the same as the measured value of the reference club.

Head Speed: 44.9 m/s
Dynamic loft: 12.3 (degree)
Blow Angle: 3.0 (degree)
Ball Initial Velocity: 64.2 m/s
Launch Angle: 13.3 (degree)
Backspin: 1750 (rpm)

The flight distances (the average values of seven data) of the reference club and recommended club were as follows. In the tester TA, the flight distance in the reference club was 242.7 yards, and the flight distance in the recommended club was 250.1 yards. In the tester TB, the flight distance in the reference club was 250.7 yards, and the flight distance in the recommended club was 254.6 yards. In the tester TC, the flight distance in the reference club was 261.5 yards, and the flight distance in the recommended club was 265.3 yards. In the tester TD, the flight distance in the reference club was 252.4 yards, and the flight distance in the recommended club was 254.2 yards. In all the testers, the flight distance of the recommended club was greater.

In the embodiment, the recommended loft angle directly influencing the hit ball result is determined on the basis of the blow angle hardly changed by a club specification and likely to depend on a swing. Versatile fitting is enabled on the basis of the blow angle hardly changed by the club specification. That is, even if a specification (a position of a center of gravity of a head and flex point of a shaft or the like) difference exists between the reference club and the recommended club, highly accurate fitting can be realized. The blow angle has a high degree of dependence on each golf player's swing. In the blow angle, the feature of the swing of each golf player is likely to appear. Fitting having high conformity to each golf player is enabled by utilizing the blow angle. Furthermore, the hit ball result can be effectively improved by focusing attention on the loft angle and dynamic loft having a high degree of incidence to the hit ball result. Since the hit ball result is fluctuated by the hit point or the like, an error is large in the selection of the loft angle based on the hit ball result. In the embodiment, the optimal recommended loft angle to each golf player's swing can be selected with accuracy without being based on the hit ball result.

The description hereinabove is merely for an illustrative example, and various modifications can be made in the scope not to depart from the principles of the present invention.

What is claimed is:

1. A fitting method of a golf club by using a fitting apparatus, wherein the fitting apparatus comprises:

an image photographing device;
a sensor;
a control apparatus; and
a processor, said fitting method comprising the following steps of:

creating a hit ball result database based on ball initial velocity prediction data, launch angle prediction data, and back spin prediction data, the ball initial velocity prediction data being data capable of predicting a ball initial velocity based on the dynamic loft and the blow angle, the launch angle prediction data being data capable of predicting a launch angle based on the dynamic loft and the blow angle, and the backspin prediction data being data capable of predicting a backspin based on the dynamic loft and the blow angle, wherein the hit ball result database is obtained by actual measurement and/or a simulation;

measuring a subject's head speed, dynamic loft, and blow angle using a reference club including a head and a shaft, by using the fitting apparatus, wherein the step of measuring comprises:

the control apparatus transmitting a photographing start signal and a photographing stop signal to the image photographing device;

the control apparatus receiving a signal of a head image near the impact from the image photographing device;

the control apparatus receiving a detection signal of the head or the shaft of the reference club from the sensor;

the control apparatus outputting the signal of the head image and the detection signal to the processor; and the processor obtaining the subject's head speed, dynamic loft, and blow angle from the signal of the head image and the detection signal;

determining, by the processor, a suitable dynamic loft based on only the measured head speed, the measured dynamic loft, and the measured blow angle, the suitable dynamic loft being defined as a dynamic loft achieving a predetermined hit ball result, wherein the hit ball result database is used for determining the suitable dynamic loft, the hit ball result database includes correlation data between the dynamic loft and the blow angle which are created for each set head speed, and the hit ball results in the dynamic lofts in the measured blow angle are compared using the hit ball result database;

determining a dynamic loft difference from the suitable dynamic loft and the measured dynamic loft;

determining a recommended loft angle based on a loft angle of the reference club and the dynamic loft difference;

selecting a recommended golf club for the subject based on the recommended loft angle; and outputting the recommended loft angle and the recommended golf club to an output device, wherein the hit ball result includes a flight distance, and wherein the hit ball result database is flight distance prediction maps created for each set head speed, each of the flight distance prediction maps being a contour line map showing correlation between the dynamic loft and the blow angle.

2. The fitting method according to claim 1, wherein the recommended loft angle is selected from a plurality of previously prepared recommended loft angle candidates in the step of determining the recommended loft angle.

3. The fitting method according to claim 1, wherein the contour line map created for a set head speed that is nearest to the measured head speed is used for determining the suitable dynamic loft, the contour line map is searched on a straight line of the measured blow angle, and one dynamic loft having a good flight distance is determined as the suitable dynamic loft.

4. A fitting method of a golf club by using a fitting apparatus, wherein the fitting apparatus comprises:

an image photographing device;

a sensor;

a control apparatus; and a processor, said fitting method comprising the following steps of:

creating a hit ball result database based on ball initial velocity prediction data, launch angle prediction data, and back spin prediction data, the ball initial velocity prediction data being data capable of predicting a ball initial velocity based on a dynamic loft and a blow angle, the launch angle prediction data being data capable of predicting a launch angle based on the dynamic loft and the blow angle, and the backspin prediction data being data capable of predicting a backspin based on the dynamic loft and the blow angle, wherein the hit ball result database is obtained by actual measurement and/or a simulation;

measuring a subject's head speed, dynamic loft, and blow angle using a reference club including a head and a shaft, by using the fitting apparatus, wherein the step of measuring comprises:

the control apparatus transmitting a photographing start signal and a photographing stop signal to the image photographing device;

the control apparatus receiving a signal of a head image near the impact from the image photographing device;

the control apparatus receiving a detection signal of the head or the shaft of the reference club from the sensor;

the control apparatus outputting the signal of the head image and the detection signal to the processor; and the processor obtaining the subject's head speed, dynamic loft, and blow angle from the signal of the head image and the detection signal;

determining, by the processor, a suitable dynamic loft based on only the measured head speed, the measured dynamic loft, and the measured blow angle, the suitable dynamic loft being defined as a dynamic loft achieving a predetermined hit ball result, wherein the hit ball result database is used for determining the suitable dynamic loft, the hit ball result database includes correlation data between the dynamic loft and the blow angle which are created for each set head speed, and the hit ball results in the dynamic lofts in the measured blow angle are compared using the hit ball result database;

determining a dynamic loft difference from the suitable dynamic loft and the measured dynamic loft;

determining a recommended loft angle based on a loft angle of the reference club and the dynamic loft difference;

selecting a recommended golf club for the subject based on the recommended loft angle; and outputting the recommended loft angle and the recommended golf club to an output device, wherein the hit ball result includes a flight distance, and the reference club is a driver.

5. A fitting method of a golf club by using a fitting apparatus, wherein the fitting apparatus comprises:

an image photographing device;

a sensor;

a control apparatus; and a processor, said fitting method comprising the following steps of:

creating a hit ball result database based on ball initial velocity prediction data, launch angle prediction data, and back spin prediction data, the ball initial velocity prediction data being data capable of predicting a ball initial velocity based on a dynamic loft and a blow angle, the launch angle prediction data being data capable of predicting a launch angle based on the dynamic loft and the blow angle, and the backspin prediction data being data capable of predicting a backspin based on the dynamic loft and the blow angle, wherein the hit ball result database is obtained by actual measurement and/or a simulation;

measuring a subject's head speed, dynamic loft, and blow angle using a reference club including a head and a shaft, by using the fitting apparatus, wherein the step of measuring comprises:

the control apparatus transmitting a photographing start signal and a photographing stop signal to the image photographing device;

the control apparatus receiving a signal of a head image near the impact from the image photographing device;

the control apparatus receiving a detection signal of the head or the shaft of the reference club from the sensor;

the control apparatus outputting the signal of the head image and the detection signal to the processor; and the processor obtaining the subject's head speed, dynamic loft, and blow angle from the signal of the head image and the detection signal;

determining, by the processor, a suitable dynamic loft based on only the measured head speed, the measured dynamic loft, and the measured blow angle, the suitable dynamic loft being defined as a dynamic loft achieving a predetermined hit ball result, wherein the hit ball result database is used for determining the suitable dynamic loft, the hit ball result database includes correlation data between the dynamic loft and the blow angle which are created for each set head speed, and the hit ball results in the dynamic lofts in the measured blow angle are compared using the hit ball result database;

determining a dynamic loft difference from the suitable dynamic loft and the measured dynamic loft;

determining a recommended loft angle based on a loft angle of the reference club and the dynamic loft difference;

selecting a recommended golf club for the subject based on the recommended loft angle; and outputting the recommended loft angle and the recommended golf club to an output device, wherein the hit ball result includes a flight distance, and the hit ball result database is made for each of at least three kinds of head speeds.

6. A fitting method of a golf club by using a fitting apparatus, wherein the fitting apparatus comprises:

an image photographing device;

a sensor;

a control apparatus; and a processor, said fitting method comprising the following steps of:

creating a hit ball result database based on ball initial velocity prediction data, launch angle prediction data, and back spin prediction data, the ball initial velocity prediction data being data capable of predicting a ball initial velocity based on a dynamic loft and a blow angle, the launch angle prediction data being data capable of predicting a launch angle based on the dynamic loft and the blow angle, and the backspin prediction data being data capable of predicting a backspin based on the dynamic loft and the blow angle, wherein the hit ball result database is obtained by actual measurement and/or a simulation;

measuring a subject's head speed, dynamic loft, and blow angle using a reference club including a head and a shaft, by using the fitting apparatus, wherein the step of measuring comprises:

the control apparatus transmitting a photographing start signal and a photographing stop signal to the image photographing device;

the control apparatus receiving a signal of a head image near the impact from the image photographing device;

the control apparatus receiving a detection signal of the head or the shaft of the reference club from the sensor;

the control apparatus outputting the signal of the head image and the detection signal to the processor; and the processor obtaining the subject's head speed, dynamic loft, and blow angle from the signal of the head image and the detection signal;

determining, by the processor, a suitable dynamic loft based on only the measured head speed, the measured dynamic loft, and the measured blow angle, the suitable dynamic loft being defined as a dynamic loft achieving a predetermined hit ball result, wherein the hit ball result database is used for determining the suitable dynamic loft, the hit ball result database includes correlation data between the dynamic loft and the blow angle which are created for each set head speed, and the hit ball results in the dynamic lofts in the measured blow angle are compared using the hit ball result database;

determining a dynamic loft difference from the suitable dynamic loft and the measured dynamic loft;

determining a recommended loft angle based on a loft angle of the reference club and the dynamic loft difference;

selecting a recommended golf club for the subject based on the recommended loft angle; and outputting the recommended loft angle and the recommended golf club to an output device, wherein the hit ball result includes a flight distance, and the dynamic loft is calculated based on a shaft angle of the reference club and a real loft angle of a head of the reference club in the step of measuring the subject's head speed, dynamic loft, and blow angle using the reference club.

* * * * *